US009240192B2

(12) United States Patent
Liu et al.

(10) Patent No.: US 9,240,192 B2
(45) Date of Patent: Jan. 19, 2016

(54) DEVICE AND METHOD FOR EFFICIENTLY ENCODING QUANTIZATION PARAMETERS OF SPECTRAL COEFFICIENT CODING

(75) Inventors: Zongxian Liu, Singapore (SG); Masahiro Oshikiri, Kanagawa (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 430 days.

(21) Appl. No.: 13/807,129

(22) PCT Filed: Jul. 6, 2011

(86) PCT No.: PCT/JP2011/003884

§ 371 (c)(1),
(2), (4) Date: Dec. 27, 2012

(87) PCT Pub. No.: WO2012/004998

PCT Pub. Date: Jan. 12, 2012

(65) Prior Publication Data

US 2013/0103394 A1 Apr. 25, 2013

(30) Foreign Application Priority Data

Jul. 6, 2010 (JP) ..... 2010-154232

(51) Int. Cl.
*G10L 19/12* (2013.01)
*G10L 19/02* (2013.01)
*G10L 19/038* (2013.01)

(52) U.S. Cl.
CPC ..... *G10L 19/12* (2013.01); *G10L 19/0208* (2013.01); *G10L 19/038* (2013.01)

(58) Field of Classification Search
CPC ... G10L 19/038; G10L 19/12; G10L 19/0208; G10L 19/16
See application file for complete search history.

(56) References Cited

U.S. PATENT DOCUMENTS 5,987,407 A * 11/1999 Wu et al. ..... 704/200.1
8,374,883 B2 2/2013 Zhong et al.

(Continued)

FOREIGN PATENT DOCUMENTS

JP 2004-120623 4/2004
JP 2009-153157 7/2009

OTHER PUBLICATIONS

"ITU-T G.718-Development of Speech/Audio Codec for Next-Generation Mobile Communication Systems", Panasonic Technical Journal, vol. 55, No. 1, Apr. 2009, pp. 21, together with its partial English translation.

(Continued)

*Primary Examiner* — Angela A Armstrong
(74) *Attorney, Agent, or Firm* — Greenblum & Bernstein, P.L.C.

(57) ABSTRACT

This invention introduces apparatus and methods to efficiently encode the quantization parameters of split multi-rate lattice vector quantization. In this invention, by doing spectral analysis on the split multi-rate vector quantized spectrum, the spectrum is split to null vectors region and non-null vectors region. For the null vectors region, instead of transmitting series of indication for null vectors, an indication of null vectors region and the quantized value of index of the ending vector in the null vectors region (or the number of the null vectors in the null vectors region) are transmitted. The indication of null vectors region can be designed in many ways, the only requirement is the indication should be distinguishable in the decoder side. The ending index or the number of null vectors can be quantized by an adaptively designed codebook. By applying of the invented method, some bits can be saved from the codebook indications.

11 Claims, 21 Drawing Sheets

(56) References Cited

U.S. PATENT DOCUMENTS

| | | | | |
|---|---|---|---|---|
| 2005/0163323 | A1* | 7/2005 | Oshikiri | 381/22 |
| 2009/0207933 | A1 | 8/2009 | Ragot et al. | |
| 2010/0057447 | A1* | 3/2010 | Ehara | 704/219 |
| 2010/0228551 | A1 | 9/2010 | Ragot et al. | |

OTHER PUBLICATIONS

"ITU-T EV-VBR: A robust 8-32 KBIT/S Scalable coder for error prone telecommunications channels", Vaillancourt, pp. 1-5.

Xie, M., "Embedded algebraic vector quantizers (EAVQ) with application to wideband speech coding ", 1996, pp. 240-243.

"Extended AMR Wideband Speech Codec (AMR-WB+)", 3GPP ts 26.290, Mar. 2007, pp. 1-85.

Ragot et al., "Low-complexity multi-rate lattice vector quanization with application to wideband tcx speech coding at 32 KBIT/S", IEEE, 2004, pp. I-501-I-504.

Chatterjee et al., "Sequential split vector quantization of LSF parameters using conditional PDF", IEEE, 2007, pp. IV-1101-IV-1104.

Han et al., "Multicodebook aplit vector quantization of LSF parameters", IEEE, 2002, pp. 418-421.

Shi et al., "On the use of splitting vectors with zero components for constrained encoder design", IEEE, 1996, pp. 1542-1544.

U.S. Appl. No. 13/822,810 to Zongxian Liu et al., which was filed on Mar. 13, 2013.

Brandenburg, "MP3 and AAC Explained", AES 17th International Conference on High Quality Audio Coding, pp. 1-12.

Lefebvre et al., "High quality coding of wideband audio signals using transform coded excitation (TCX)", 1994, pp. I-193-I-196.

"G.729-based embedded variable bit-rate coder: An 8-32 kbit/s scalable wideband coder bitstream . . . ", ITU-T Recommendation 6.729. 1, 2007, pp. 1-99.

* cited by examiner

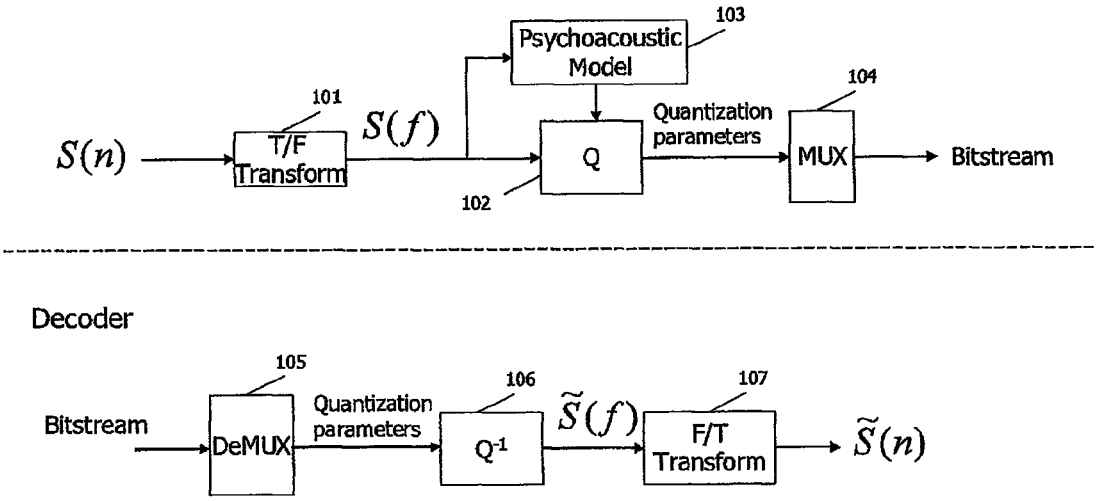
FIG.1 PRIOR ART
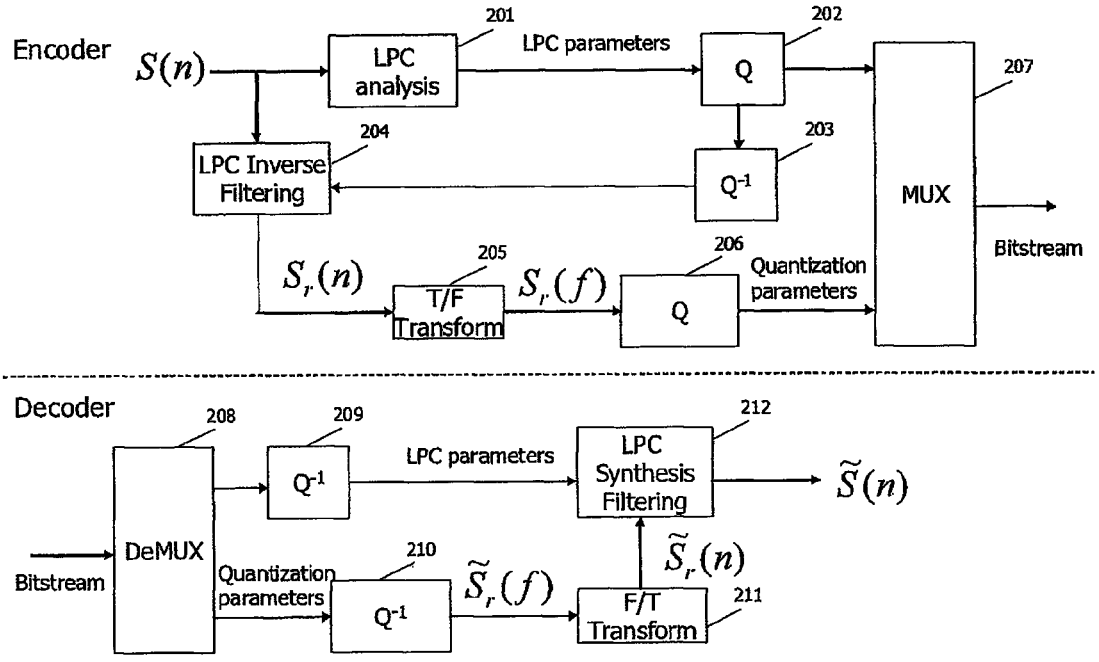
FIG.2 PRIOR ART

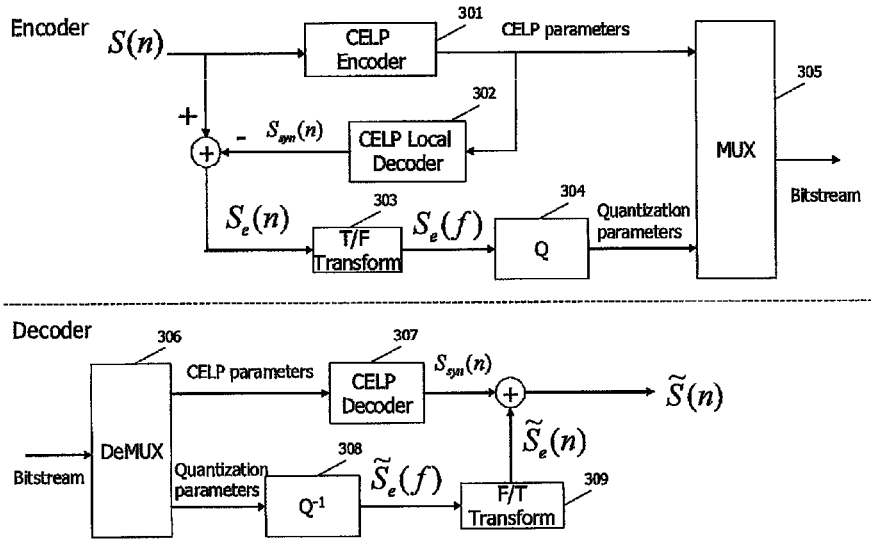
FIG.3 PRIOR ART
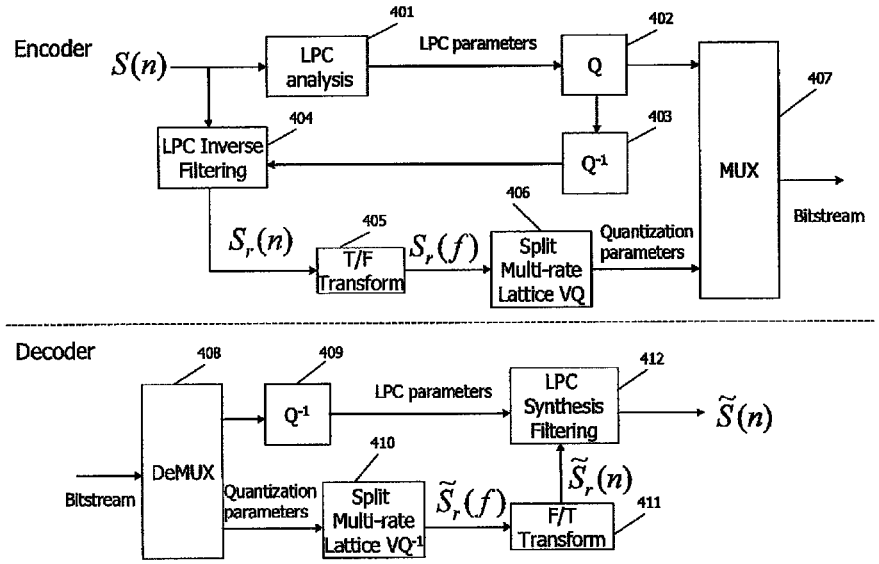
FIG.4 PRIOR ART

| Codebook | Codebook Indication | Codebook indication bits consumption | Code vector index bits consumption | Total bits consumption |
|---|---|---|---|---|
| Q0 | 0 | 1 | 0 | 1 |
| Q2 | 10 | 2 | 8 | 10 |
| Q3 | 110 | 3 | 12 | 15 |
| Q4 | 1110 | 4 | 16 | 20 |
| Q5 | 11110 | 5 | 20 | 25 |
| ⋮ | ⋮ | ⋮ | ⋮ | ⋮ |

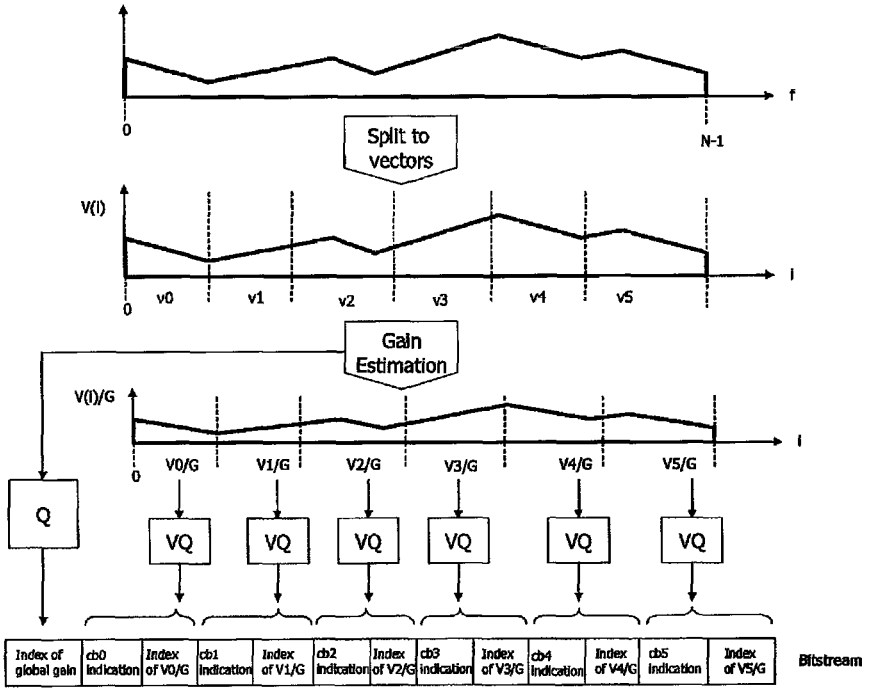
FIG.8 PRIOR ART
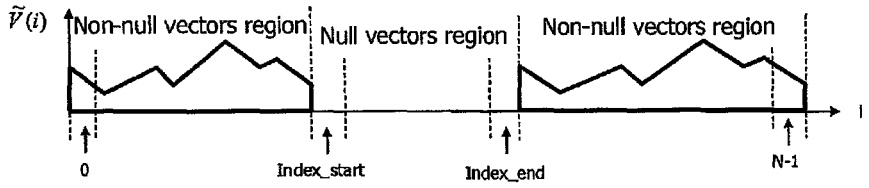
FIG.9 PRIOR ART

Codebook table of prior art

| Codebook (Qn) | Representation (Bits consumption= n) | Total bits (5*n) |
|---|---|---|
| Q0 | 0 | 1 |
| Q2 | 10 | 10 |
| Q3 | 110 | 15 |
| Q4 | 1110 | 20 |
| Q5 | 11110 | 25 |
| Q6 | 111110 | 30 |
| Q7 | 1111110 | 35 |
| Q8 | 11111110 | 40 |
| Q9 | 111111110 | 45 |
| ⋮ | ⋮ | ⋮ |

Codebook table of inventive method

| Codebook (Qn) | Representation (Bits consumption= n) | Total bits (5*n) |
|---|---|---|
| Q0 | 0 | 1 |
| Q2 | 10 | 10 |
| Q3 | 110 | 15 |
| Q4 | 1110 | 20 |
| Q5 | 11110 | 25 |
| Null vectors | 111110 | 8 |
| **Codebook (Qn)** | **Representation (Bits consumption= n+1)** | **Total bits (5*n+1)** |
| Q6 | 1111110 | 31 |
| Q7 | 11111110 | 36 |
| Q8 | 111111110 | 41 |
| ⋮ | ⋮ | ⋮ |

FIG.13

$$cb_step = \lfloor (Max - Min + 1)/4 \rfloor = \lfloor (21 - 11 + 1)/4 \rfloor = 2$$

$$\overline{Index_end} = Index_start + Threshold + cv * cb_step$$
$$cv \in \{0,1,2,3\}$$

$$cb_step = (Max - Min + 1)/4 = (21 - 11 + 1)/4 = 2.75$$

$$\overline{Index_end} = Index_start + Threshold + \lfloor cv * Cb_step \rfloor$$
$$cv \in \{0,1,2,3\}$$

Codebook table of prior art

| Codebook (Qn) | Representation (Bits consumption= n) | Total bits (6*n) |
|---|---|---|
| Q0 | 0 | 1 |
| Q2 | 10 | 10 |
| Q3 | 110 | 15 |
| Q4 | 1110 | 20 |
| Q5 | 11110 | 25 |
| Q6 | 111110 | 30 |
| Q7 | 1111110 | 35 |
| Q8 | 11111110 | 40 |
| Q9 | 111111110 | 45 |
| ⋮ | ⋮ | ⋮ |

Codebook table of inventive method

| Codebook (Qn) | Representation (Bits consumption= n) | Total bits (6*n) |
|---|---|---|
| Q0 | 0 | 1 |
| Q2 | 10 | 10 |
| Q3 | 110 | 15 |
| Q4 | 1110 | 20 |
| Q5 | 11110 | 25 |
| Null vectors | 1111101 | 9 |
| Q6 | 1111100 | 31 |
| Q7 | 1111110 | 35 |
| Q8 | 11111110 | 40 |
| Q9 | 111111110 | 45 |
| ⋮ | ⋮ | ⋮ |

Codebook table of prior art

| Codebook (Qn) | Representation (Bits consumption= n) | Total bits (5*n) |
|---|---|---|
| Q0 | 0 | 1 |
| Q2 | 10 | 10 |
| Q3 | 110 | 15 |
| Q4 | 1110 | 20 |
| Q5 | 11110 | 25 |
| Q6 | 111110 | 30 |
| Q7 | 1111110 | 35 |
| Q8 | 11111110 | 40 |
| Q9 | 111111110 | 45 |
| ⋮ | ⋮ | ⋮ |

Codebook table of inventive method

| Codebook (Qn) | Representation (Bits consumption= n) | Total bits (5*n) |
|---|---|---|
| Q0 | 0 | 1 |
| Q2 | 10 | 10 |
| Q3 | 110 | 15 |
| Q4 | 1110 | 20 |
| Q5 | 11110 | 25 |
| Null vectors (forward search) | 111110 | 8 |
| Null vectors (backward search) | 0111110 | 9 |
| Codebook (Qn) | Representation (Bits consumption= n+1) | Total bits (6*n+1) |
| Q6 | 11111110 | 31 |
| Q7 | 111111110 | 36 |
| Q8 | 1111111110 | 41 |
| ⋮ | ⋮ | ⋮ |

Codebook table of prior art

| Codebook (Qn) | Representation (Bits consumption= n) | Total bits (5*n) |
|---|---|---|
| Q0 | 0 | 1 |
| Q2 | 10 | 10 |
| Q3 | 110 | 15 |
| Q4 | 1110 | 20 |
| Q5 | 11110 | 25 |
| Q6 | 111110 | 30 |
| Q7 | 1111110 | 35 |
| Q8 | 11111110 | 40 |
| Q9 | 111111110 | 45 |
| ⋮ | ⋮ | ⋮ |

Codebook table of inventive method

| Codebook (Qn) | Representation (Bits consumption= n) | Total bits (5*n) |
|---|---|---|
| Q0 | 0 | 1 |
| Q2 | 10 | 10 |
| Q3 | 110 | 15 |
| Q4 | 1110 | 20 |
| Q5 | 11110 | 25 |
| Null vectors | 111110 | 6 or 7 or 8 |
| Codebook (Qn) | Representation (Bits consumption= n+1) | Total bits (5*n+1) |
| Q6 | 1111110 | 31 |
| Q7 | 11111110 | 36 |
| Q8 | 111111110 | 41 |
| ⋮ | ⋮ | ⋮ |

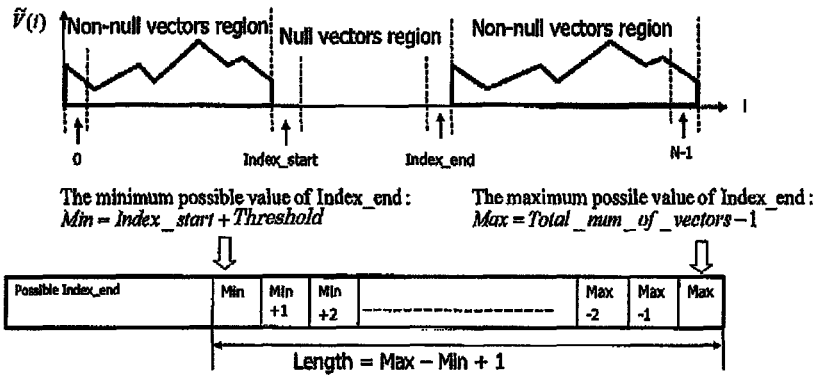

*Case* 1 : $Min = Max$, $Length = 1$

- No bit is required to indicate the value of Index_end
- Total bits consumption = 6

*Case* 2 : $Min = Max - 1$, $Length = 2$

- One bit is required to indicate the value of Index_end
- Total bits consumption = 6 + 1 =7

*Case* 3 : $Min = Max - 2$, Length = 3

- Two bits are required to indicate the value of Index_end
- Total bits consumption = 6 + 2 =8

*Case* 4 : $Min < Max - 2$, Length > 3

- The value of the Index_end are to be quantized by 2 bits codebook (which have 4 representative values).
- All the possible value of Index_end are split to 4 portions. Each portion is represented by one representative value.
- The step of each portion is
  Cb_step = (Max-Min+1)/4
- Total bits consumption = 6 + 2 =8

FIG.21

Table 1

| Codebook (Qn) | Representation (Bits consumption= n) | Total bits (5*n) |
|---|---|---|
| Q0 | 0 | 1 |
| Q2 | 10 | 10 |
| Q3 | 110 | 15 |
| Q4 | 1110 | 20 |
| Q5 | 11110 | 25 |
| Q6 | 111110 | 30 |
| Q7 | 1111110 | 35 |
| Q8 | 11111110 | 40 |
| Q9 | 111111110 | 45 |
| ⋮ | ⋮ | ⋮ |

Or

Table 2

| Codebook (Qn) | Representation (Bits consumption= n) | Total bits (5*n) |
|---|---|---|
| Q0 | 0 | 1 |
| Q2 | 10 | 10 |
| Q3 | 110 | 15 |
| Q4 | 1110 | 20 |
| Q5 | 11110 | 25 |
| Null vectors | 111110 | 8 |
| **Codebook (Qn)** | **Representation (Bits consumption= n+1)** | **Total bits (5*n+1)** |
| Q6 | 1111110 | 31 |
| Q7 | 11111110 | 36 |
| Q8 | 111111110 | 41 |
| ⋮ | ⋮ | ⋮ |

FIG.22

*Case 1: No codebook is or higher than the null vectors indication, Q6 in our case*
*when index <= Total_num_of_vectors - Threshold*
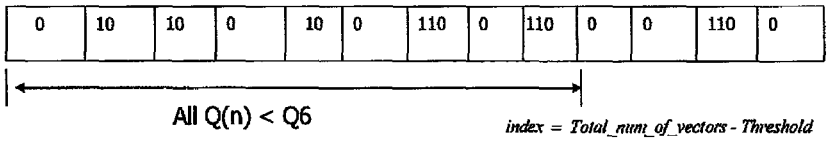
*Case 2:* Null vectors region exist
*when index <= Total_num_of_vectors - Threshold*
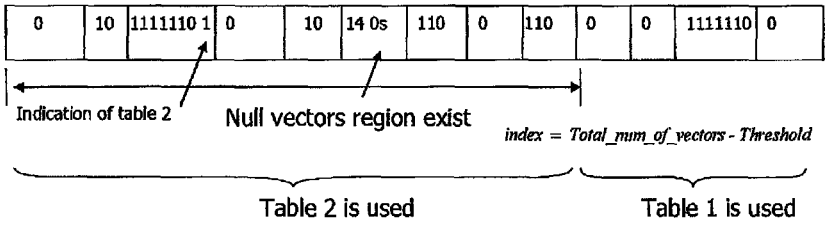
*Case 3:* Null vectors region doesn't exist, but some vectors using codebook > Q5
*when index <= Total_num_of_vectors - Threshold*
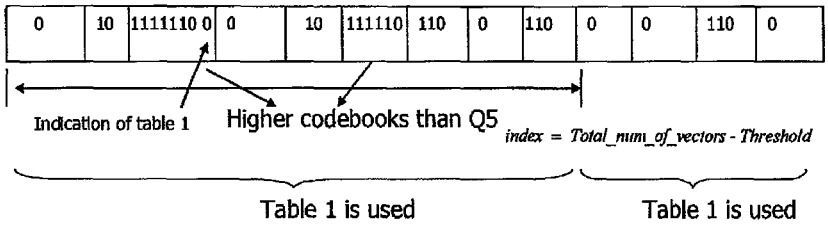
FIG.23

Codebook table of prior art

| Codebook (Qn) | Representation (Bits consumption= n) | Total bits (5*n) |
|---|---|---|
| Q0 | 0 | 1 |
| Q2 | 10 | 10 |
| Q3 | 110 | 15 |
| Q4 | 1110 | 20 |
| Q5 | 11110 | 25 |
| Q6 | 111110 | 30 |
| Q7 | 1111110 | 35 |
| Q8 | 11111110 | 40 |
| Q9 | 111111110 | 45 |
| ⋮ | ⋮ | ⋮ |

Codebook table of inventive method

| Codebook (Qn) | Representation (Bits consumption= n) | Total bits (5*n) |
|---|---|---|
| Q0 | 0 | 1 |
| Q2 | 10 | 10 |
| Q3 | 110 | 15 |
| Q4 | 1110 | 20 |
| Q5 | 11110 | 25 |
| Null vectors (forward search) | 111110 | 6 or 7 or 8 |
| Null vectors (backward search) | 011110 | 9 |
| Null vectors (up to last vector) | 00111110 | 8 |
| Codebook (Qn) | Representation (Bits consumption= n+1) | Total bits (5*n+1) |
| Q6 | 1111110 | 31 |
| Q7 | 11111110 | 36 |
| Q8 | 111111110 | 41 |
| ⋮ | ⋮ | ⋮ |

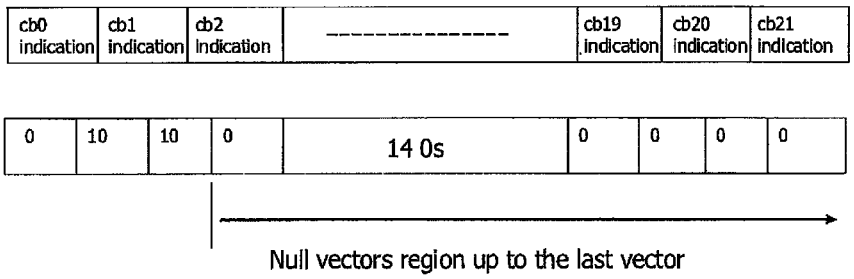

FIG.24

DEVICE AND METHOD FOR EFFICIENTLY ENCODING QUANTIZATION PARAMETERS OF SPECTRAL COEFFICIENT CODING

TECHNICAL FIELD

The present invention relates to a audio/speech encoding apparatus, audio/speech decoding apparatus and audio/speech encoding and decoding methods using vector quantization.

BACKGROUND ART

In audio and speech coding, there are mainly two types of coding approaches: Transform Coding and Linear Prediction Coding.

Transform coding involves the transformation of the signal from time domain to spectral domain, such as using Discrete Fourier Transform (DFT) or Modified Discrete Cosine Transform (MDCT). The spectral coefficients are quantized and encoded. In the process of quantization or encoding, psychoacoustic model is normally applied to determine the perceptual importance of the spectral coefficients, and then the spectral coefficients are quantized or encoded according to their perceptual importance. Some popular transform codecs are MPEG MP3, MPEG AAC [1] and Dolby AC3. Transform coding is effective for music or general audio signals. A simple framework of transform codec is shown in FIG. 1.

In the encoder illustrated in FIG. 1, the time domain signal S(n) is transformed into frequency domain signal S(f) using time to frequency transformation method (101), such as Discrete Fourier Transform (DFT) or Modified Discrete Cosine Transform (MDCT).

Psychoacoustic model analysis is done on the frequency domain signal S(f) to derive the masking curve (103). Quantization is applied on the frequency domain signal S(f) (102) according to the masking curve derived from the psychoacoustic model analysis to ensure that the quantization noise is inaudible.

The quantization parameters are multiplexed (104) and transmitted to the decoder side.

In the decoder illustrated in FIG. 1, at the start, all the bitstream information is de-multiplexed at (105). The quantization parameters are dequantized to reconstruct the decoded frequency domains signal $\tilde{S}(f)$ (106).

The decoded frequency domain signal $\tilde{S}(f)$ is transformed back to time domain, to reconstruct the decoded time domain signal $\tilde{S}(n)$ using frequency to time transformation method (107), such as Inverse Discrete Fourier Transform (IDFT) or Inverse Modified Discrete Cosine Transform (IMDCT).

On the other hand, linear prediction coding exploits the predictable nature of speech signals in time domain, obtains the residual/excitation signal by applying linear prediction on the input speech signal. For speech signal, especially for voiced regions, which have resonant effect and high degree of similarity over time shifts that are multiples of their pitch periods, this modelling produces very efficient presentation of the sound. After the linear prediction, the residual/excitation signal is mainly encoded by two different methods, TCX and CELP.

In TCX [2], the residual/excitation signal is transformed and encoded efficiently in the frequency domain. Some popular TCX codecs are 3GPP AMR-WB+, MPEG USAC. A simple framework of TCX codec is shown in FIG. 2.

In the encoder illustrated in FIG. 2, LPC analysis is done on the input signal to exploit the predictable nature of signals in time domain (201). The LPC coefficients from the LPC analysis are quantized (202), the quantization indices are multiplexed (207) and transmitted to decoder side. With the dequantized LPC coefficients from dequantization module (203), the residual (excitation) signal $S_r(n)$ is obtained by applying LPC inverse filtering on the input signal S(n) (204).

The residual signal $S_r(n)$ is transformed to frequency domain signal $S_r(f)$ using time to frequency transformation method (205), such as Discrete Fourier Transform (DFT) or Modified Discrete Cosine Transform (MDCT).

Quantization is applied on $S_r(f)$ (206) and quantization parameters are multiplexed (207) and transmitted to the decoder side.

In the decoder illustrated in FIG. 2, at the start, all the bitstream information is de-multiplexed at (208).

The quantization parameters are dequantized to reconstruct the decoded frequency domain residual signal $\tilde{S}_r(f)$ (210).

The decoded frequency domain residual signal $\tilde{S}_r(f)$ is transformed back to time domain, to reconstruct the decoded time domain residual signal $\tilde{S}_r(n)$ using frequency to time transformation method (211), such as Inverse Discrete Fourier Transform (IDFT) or Inverse Modified Discrete Cosine Transform (IMDCT).

With the dequantized LPC parameters from the dequantization module (209), the decoded time domain residual signal $\tilde{S}_r(n)$ is processed by LPC synthesis filter (212) to obtain the decoded time domain signal $\tilde{S}(n)$.

In the CELP coding, the residual/excitation signal is quantized using some predetermined codebook. And in order to further enhance the sound quality, it is popular to transform the difference signal between the original signal and the LPC synthesized signal to frequency domain and further encode. Some popular CELP codecs are ITU-T G.729.1 [3], ITU-T G.718[4]. A simple framework of hierarchical coding (layered coding, embedded coding) of CELP and transform coding is shown in FIG. 3.

In the encoder illustrated in FIG. 3, CELP encoding is done on the input signal to exploit the predictable nature of signals in time domain (301). With the CELP parameters, the synthesized signal $S_{syn}(n)$ is reconstructed by the CELP local decoder (302). The prediction error signal $S_e(n)$ (the difference signal between the input signal and the synthesized signal) is obtained by subtracting the synthesized signal from the input signal.

The prediction error signal $S_e(n)$ is transformed into frequency domain signal $S_e(f)$ using time to frequency transformation method (303), such as Discrete Fourier Transform (DFT) or Modified Discrete Cosine Transform (MDCT).

Quantization is applied on $S_e(f)$ (304) and quantization parameters are multiplexed (305) and transmitted to the decoder side.

In the decoder illustrated in FIG. 3, at the start, all the bitstream information is de-multiplexed at (306).

The quantization parameters are dequantized to reconstruct the decoded frequency domain residual signal $\tilde{S}_e(f)$ (308).

The decoded frequency domain residual signal $\tilde{S}_e(f)$ is transformed back to time domain, to reconstruct the decoded time domain residual signal $\tilde{S}_e(n)$ using frequency to time transformation method (309), such as Inverse Discrete Fourier Transform (IDFT) or Inverse Modified Discrete Cosine Transform (IMDCT).

With the CELP parameters, the CELP decoder reconstructs the synthesized signal $S_{syn}(n)$ (307), the decoded time domain signal $\tilde{S}(n)$ is reconstructed by summing up the CELP synthesized signal $S_{syn}(n)$ and the decoded prediction error signal $\tilde{S}_e(n)$.

The transform coding and the transform coding part in linear prediction coding are normally performed by utilizing some quantization methods.

One of the vector quantization methods is named as split multi-rate lattice VQ or algebraic VQ (AVQ) [5]. In AMR-WB+ [6], split multi-rate lattice VQ is used to quantize the LPC residual in TCX domain (as shown in FIG. 4). In the newly standardized speech codec ITU-T G.718, split multi-rate lattice VQ is also used to quantize the LPC residue in MDCT domain as residue coding layer 3.

Split multi-rate lattice VQ is a vector quantization method based on lattice quantizers. Specifically, for the split multi-rate lattice VQ used in AMR-WB+ [6], the spectrum is quantized in blocks of 8 spectral coefficients using vector codebooks composed of subsets of the Gosset lattice, referred to as the RE8 lattice (see [5]).

All points of a given lattice can be generated from the so-called squared generator matrix G of the lattice, as $c=s \cdot G$, where s is a line vector with integer values and c is the generated lattice point.

To form a vector codebook at a given rate, only lattice points inside a sphere (in 8 dimensions) of a given radius are taken. Multi-rate codebooks can thus be formed by taking subsets of lattice points inside spheres of different radii.

A simple framework which utilizes the split multi-rate vector quantization in TCX codec is illustrated in FIG. 4.

In the encoder illustrated in FIG. 4, LPC analysis is done on the input signal to exploit the predictable nature of signals in time domain (401). The LPC coefficients from the LPC analysis are quantized (402), the quantization indices are multiplexed (407) and transmitted to decoder side. With the dequantized LPC coefficients from dequantization module (403), the residual (excitation) signal $S_r(n)$ is obtained by applying LPC inverse filtering on the input signal S(n) (404).

The residual signal $S_r(n)$ is transformed to frequency domain signal $S_r(f)$ using time to frequency transformation method (405), such as Discrete Fourier Transform (DFT) or Modified Discrete Cosine Transform (MDCT).

Split multi-rate lattice vector quantization method is applied on $S_r(f)$ (406) and quantization parameters are multiplexed (407) and transmitted to the decoder side.

In the decoder illustrated in FIG. 4, at the start, all the bitstream information is de-multiplexed at (408).

The quantization parameters are dequantized by split multi-rate lattice vector dequantization method to reconstruct the decoded frequency domain residual signal $\tilde{S}_r(f)$ (410).

The decoded frequency domain residual signal $\tilde{S}_r(f)$ is transformed back to time domain, to reconstruct the decoded time domain residual signal $\tilde{S}_r(n)$ using frequency to time transformation method (411), such as Inverse Discrete Fourier Transform (IDFT) or Inverse Modified Discrete Cosine Transform (IMDCT).

With the dequantized LPC parameters from the dequantization module (409), the decoded time domain residual signal $\tilde{S}_r(n)$ is processed by LPC synthesis filter (412) to obtain the decoded time domain signal $\tilde{S}(n)$.

FIG. 5 illustrates the process of split multi-rate lattice VQ. The input spectrum S(f) is firstly split to a number of 8-dimensional blocks (or vectors) (501), and each block (or vector) is quantized by the multi-rate lattice vector quantization method (502). In the quantization step, a global gain is firstly calculated according to the bits available and the energy level of the whole spectrum. Then for each block (or vector), the ratio between the original spectrum and the global gain is quantized by different codebooks. The quantization parameters of split multi-rate lattice VQ are the quantization index of a global gain, codebook indications for each block (or vector) and code vector indices for each block (or vector).

FIG. 6 summarizes the list of codebooks of split multi-rate lattice VQ adopted in AMR-WB+ [6]. In the table, the codebook $Q_0$, $Q_2$, $Q_3$ or $Q_4$ are the base codebooks. When a given lattice point is not included in these base codebooks, the Voronoi extension [7] is applied, using only the $Q_3$ or $Q_4$ part of the base codebook. As example, in the table, Q5 is Voronoi extension of Q3, Q6 is Voronoi extension of Q4.

Each codebook consists of a number of code vectors. The code vector index in the codebook is represented by a number of bits. The number of bits is derived by equation 1 as shown below:

$$N_{bits}=\log_2(N_{cv}) \quad \text{(Equation 1)}$$

where $N_{bits}$ means the number of bits consumed by the code vector index $N_{cv}$ means the number of code vectors in the codebook In the codebook Q0, there is only one vector, the null vector, means the quantized value of the vector is 0. Therefore no bits are required for the code vector index.

As there are three sets of the quantization parameters for split multi-rate lattice VQ: the index of global gain, the indications of the codebooks and the indices of the code vectors. The bitstream are normally formed in two ways. The first method is illustrated in FIG. 7, and the second method is illustrated in FIG. 8.

In FIG. 7, the input signal S(f) is firstly split to a number of vectors. Then a global gain is derived according to the bits available and the energy level of the spectrum. The global gain is quantized by a scalar quantizer and the S(f)/G is quantized by the multi-rate lattice vector quantizer. When the bitstream is formed, the index of the global gain forms the first portion, all the codebook indications are grouped together to form the second portion and all the indices of the code vectors are grouped together to form the last portion.

In FIG. 8, the input signal S(f) is firstly split to a number of vectors. Then a global gain is derived according to the bits available and the energy level of the spectrum. The global gain is quantized by a scalar quantizer and the S(f)/G is quantized by the multi-rate lattice vector quantizer. When the bitstream is formed, the index of the global gain forms the first portion, the codebook indication followed by the code vector index for each vector is to form the second portion.

CITATION LIST

Non-Patent Literature

NPL 1

Karl Heinz Brandenburg, "MP3 and AAC Explained", *AES 17th International Conference*, Florence, Italy, September 1999.

NPL 2

Lefebvre, et al., "High quality coding of wideband audio signals using transform coded excitation (TCX)", *IEEE International Conference on Acoustics, Speech, and Signal Processing*, vol. 1, pp. I/193-I/196, April 1994

NPL 3

ITU-T Recommendation G.729.1 (2007) "G.729-based embedded variable bit-rate coder: An 8-32 kbit/s scalable wideband coder bitstream interoperable with G.729"

NPL 4

T. Vaillancourt et al, "ITU-T EV-VBR: A Robust 8-32 kbit/s Scalable Coder for Error Prone Telecommunication Channels", in *Proc. Eusipco*, Lausanne, Switzerland, August 2008

NPL 5

M. Xie and J.-P. Adoul, "Embedded algebraic vector quantization (EAVQ) with application to wideband audio coding," IEEE International Conference on Acoustics, Speech, and Signal Processing (ICASSP), Atlanta, Ga., U.S.A, 1996, vol. 1, pp. 240-243

NPL 6

3GPP TS 26.290 "Extended AMR Wideband Speech Codec (AMR-WB+)"

NPL 7

S. Ragot, B. Bessette and R. Lefebvre, "Low-complexity Multi-Rate Lattice Vector Quantization with Application to Wideband TCX Speech Coding at 32 kbit/s," Proc. IEEE International Conference on Acoustics, Speech, and Signal Processing (ICASSP), Montreal, QC, Canada, May, 2004, vol. 1, pp. 501-504

SUMMARY OF INVENTION

Technical Problem

When the bits available are not many, or when the spectrum to be quantized concentrates energy in certain frequency band, it happens that many vectors are quantized as 0 (null vector), results in a lot of null vectors in the decoded spectrum, in other words, the spectrum is very sparse.

In prior arts, the codebook indications and code vector indices are directly converted to binary number and form the bit stream.

Therefore the total bits consumption for all the vectors can be calculated in the following manner:

$$Bits_{total} = Bits_{gain_q} + \sum_{i=0}^{N-1} Bits_{cb_indication}(i) + \sum_{i=0}^{N-1} Bits_{cv_index}(i) \quad \text{(Equation 2)}$$

where $Bits_{total}$ is the total bits consumption $Bits_{gain_q}$ is the bits consumption for quantization of the global gain $Bits_{cb_indication}$ is the bits consumption for the codebook indication for each vector $Bits_{cv_index}$ is the bits consumption for the code vector index for each vector N is the total number of vectors in the whole spectrum The sparseness of the spectrum is not exploited to achieve possible bits saving, in other words, some bits are wasted to indicate the null vectors.

Solution to Problem

In this invention, an efficient method is introduced to convert the AVQ codebook indications for null vectors to another efficient index by exploiting the sparseness of the signal spectrum.

Because Q0 is indication of null vectors and all other codebooks are indication of non-null vectors, the spectral sparseness information can be achieved by analyzing the codebook indications of all the vectors. This step is named as spectral cluster analysis and the detail process is illustrated as below:

1) In the spectrum, all the null vectors portions which only consist of null vectors (which are quantized with Q0) are found, and the number of null vectors in each portion is counted.
2) If the number of null vectors in the portion is larger than Threshold, it is classified as null-vectors region. Otherwise, the null vectors and neighbouring non-null vectors are combined and classified as non-null vectors region.
3) Threshold is determined according to the bits consumption for the indication of null vectors region and the encoding of the index of the ending vector (ending index) of the null vectors region.

$$\text{Threshold}=\text{Bits}_{null_vectors_region}=\text{Bits}_{indication}+\text{Bits}_{Index_end} \quad \text{(Equation 3)}$$

where $\text{Bits}_{null_vectors_region}$ is the total bits consumption to encode the null vectors region $\text{Bits}_{indicaiton}$ is the bits consumption to inidcate the null vectors region $\text{Bits}_{index_end}$ is the bits consumption to encode the ending index of the null vectors region Threshold is the threshold to judge the null vectors region 4) For the null vectors region, instead of transmitting Q0 index for each null vector, an indication of null vectors region and the index of the ending vector (ending index) of the null vectors region are transmitted.
5) The indication of null vectors region can be designed in many ways, the only requirement is the indication should be distinguishable in the decoder side.
6) The value of the index of the ending vector (ending index) is quantized by adaptively designed codebook. In the codebook, the representative values can be designed according to the number of the possible values of the index of the ending vector (ending index).

An example is illustrated in FIG. 9. In this figure, for ease of understanding, the decoded spectrum is illustrated. In the example, there are three portions, two non-null vectors regions and one null vectors region. The index of the starting vector of the null vectors region is notified as Index_start and the index of the ending vector of the null vectors region is notified as Index_end. As mentioned in step 3, the null vectors region only consists of null vectors while the non-null vectors region doesn't have to only consist of non-null vectors, the non-null vectors region may also have some null vectors.

For the conventional method, the parameters to be transmitted are:

1) Quantization index of the global gain
2) Codebook indications for all the vectors
3) Code vector indices for all the vectors The total bits consumption for encoding of all the parameters is found as follows (it is assumed that bits available are enough to encode the parameters for all the vectors):

$$Bits_{total} = Bits_{gain_q} + \sum_{i=0}^{N-1} Bits_{cb_indication}(i) + \sum_{i=0}^{N-1} Bits_{cv_index}(i) \quad \text{(Equation 4)}$$

where $Bits_{total}$ is the total bits consumption $Bits_{gain_q}$ is the bits consumption for quantization of the global gain $Bits_{cb_indication}$ is the bits consumption for the codebook indication for each vector $Bits_{cv_index}$ is the bits consumption for the code vector index for each vector N is the total number of vectors in the whole spectrum As the null vectors are quantized by Q0, therefore, for each null vector, one bit is consumed.

Then, $$Bits_{original} = Bits_{gain_q} + \sum_{i=0}^{Index_start-1} Bits_{cb_indication}(i) + \sum_{i=0}^{Index_start-1} Bits_{cv_index}(i) + \sum_{i=Index_end+1}^{N-1} Bits_{cb_indication}(i) + \sum_{i=Index_end+1}^{N-1} Bits_{cv_index}(i) + (\text{Index_end} - \text{Index_start} + 1) \quad \text{(Equation 5)}$$

where $Bits_{original}$ is the total bits consumption for the conventional method $Bits_{gain_q}$ is the bits consumption for quantization of the global gain $Bits_{cb_indication}$ is the bits consumption for the codebook indication for each vector $Bits_{cv_index}$ is the bits consumption for the code vector index for each vector Index_start is the index of the starting vector of the null vectors region Index_end is the index of the ending vector of the null vectors region For the method proposed in this invention, the parameters to be transmitted are:

1) Quantization index of the global gain
2) Codebook indications for all the vectors in non-null vectors region
3) Code vector indices for all the vectors in non-null vectors region
4) Indication of null vectors region
5) Index of the ending vector (ending index) of null vectors region (or the number of null vectors in the null vectors region)

The total bits consumption for encoding of all the parameters (it is assumed that bits available are enough to encode the parameters for all the vectors):

$$Bits_{new} = Bits_{gain_q} + \sum_{i=0}^{Index_start-1} Bits_{cb_indication}(i) + \sum_{i=0}^{Index_start-1} Bits_{cv_index}(i) + \sum_{i=Index_end+1}^{N-1} Bits_{cb_indication}(i) + \sum_{i=Index_end+1}^{N-1} Bits_{cv_index}(i) + Bits_{indication} + Bits_{Index_end} \quad \text{(Equation 6)}$$

where $Bits_{new}$ is the total bits consumption for the proposed method in this invention $Bits_{gain_q}$ is the bits consumption for quantization of the global gain $Bits_{cb_indication}$ is the bits consumption for the codebook indication for each vector $Bits_{cv_index}$ is the bits consumption for the code vector index for each vector $Bits_{indicaiton}$ is the bits consumption to inidcate the null vectors region $Bits_{Index_end}$ is the bits consumption to encode the ending index of the null vectors region Index_end is the index of the ending vector of the null vectors region

Advantageous Effects of Invention

By applying the invented method, it is possible to achieve some bits saving. The bits saving by the method proposed in this invention is calculated as following:

$$Bits_{save} = (\text{Index_end} - \text{Index_start} + 1) - Bits_{indication} - Bits_{Index_end} \quad \text{(Equation 7)}$$

where $Bits_{save}$ is the bits saving by the proposed method in this invention $Bits_{indicaiton}$ is the bits consumption to inidcate the null vectors region $Bits_{Index_end}$ is the bits consumption to encode the ending index of the null vectors region Index_start is the index of the starting vector of the null vectors region Index_end is the index of the ending vector of the null vectors region In the spectral cluster analysis step 2), it is examined that the number of vectors in the null vectors region is larger than Threshold.

$$Num_{null_vectors} = (\text{Index_end} - \text{Index_start} + 1) > \text{Threshold} \quad \text{(Equation 8)}$$

where

Threshold is the threshold to judge the null vectors region

Index_start is the index of the starting vector of the null vectors region

Index_end is the index of the ending vector of the null vectors region $Num_{null_vectors}$ is the number of null vectors in the null vectors region And Threshold is determined by equation 3.

From the two equations, equation 3 and equation 8, we can have the conclusion below:

$$(\text{Index_end} - \text{Index_start} + 1) > (Bits_{indication} + Bits_{Index_end}) \quad \text{(Equation 9)}$$

where

Index_start is the index of the starting vector of the null vectors region

Index_end is the index of the ending vector of the null vectors region $Bits_{indicaiton}$ is the bits consumption to inidcate the null vectors region $Bits_{Index_end}$ is the bits consumption to encode the ending index of the null vectors region Therefore, bits saving is achived by the proposed method in this invention (Bitssave>0).

BRIEF DESCRIPTION OF THE DRAWINGS

FIG. 1 illustrates a simple framework of transform codec;

FIG. 2 illustrates a simple framework of TCX codec;

FIG. 3 illustrates a simple framework of layered codec (CELP+transform);

FIG. 4 illustrates a framework of TCX codec which utilizes split multi-rate lattice vector quantization;

FIG. 8 illustrates another way of bit stream formation;

FIG. 9 illustrates the problem with the conventional split multi-rate lattice VQ;

FIG. 13 shows the null vectors indication table;

FIG. 21 illustrates the idea for determination of the range for the possible values of Index_end;

FIG. 22 shows the two indication tables used for null vectors region indication;

FIG. 23 shows the three conditions to utilize different indication tables;

FIG. 24 shows the indication table which covers the indication for null vectors region up to last vector;

DESCRIPTION OF EMBODIMENTS

The main principle of the invention is described in this section with the aid of FIG. 10 to FIG. 29. Those who are skilled in the art will be able to modify and adapt this invention without deviating from the spirit of the invention. Illustrations are provided to facilitate explanation.

(Embodiment 1)

Figures 5, 6:
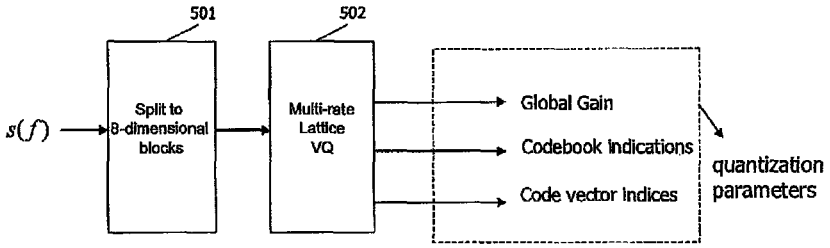
FIG.5 PRIOR ART
FIG.6 PRIOR ART
FIG. 5 illustrates the process of split multi-rate lattice vector quantization.
FIG. 6 shows the table of the codebooks for split multi-rate lattice VQ.
Figure 7:
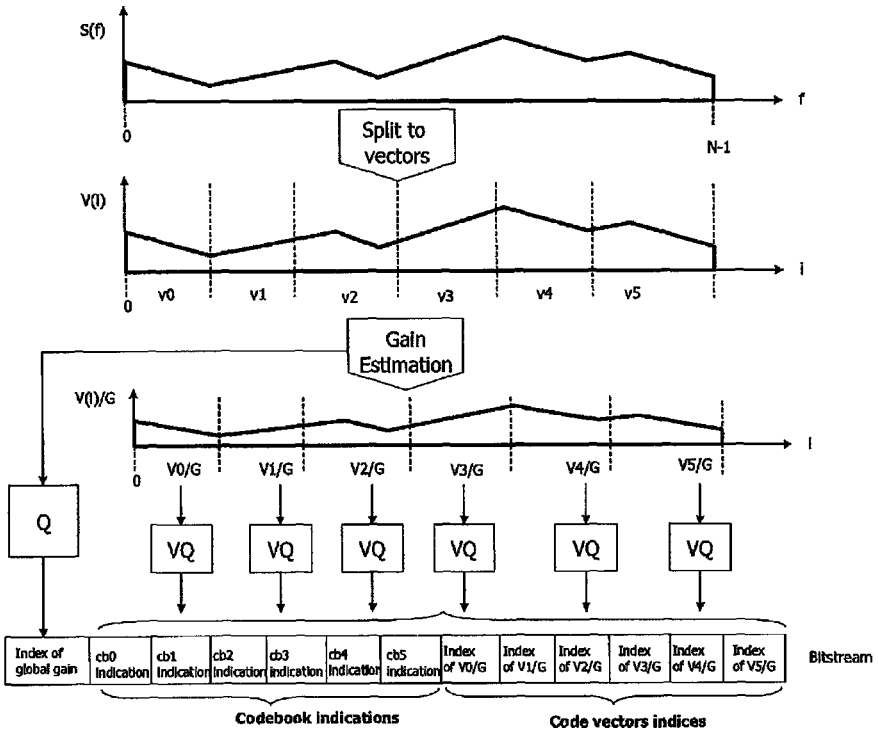
PRIOR ART FIG.7
FIG. 7 illustrates one way of bit stream formation.
Figure 10:
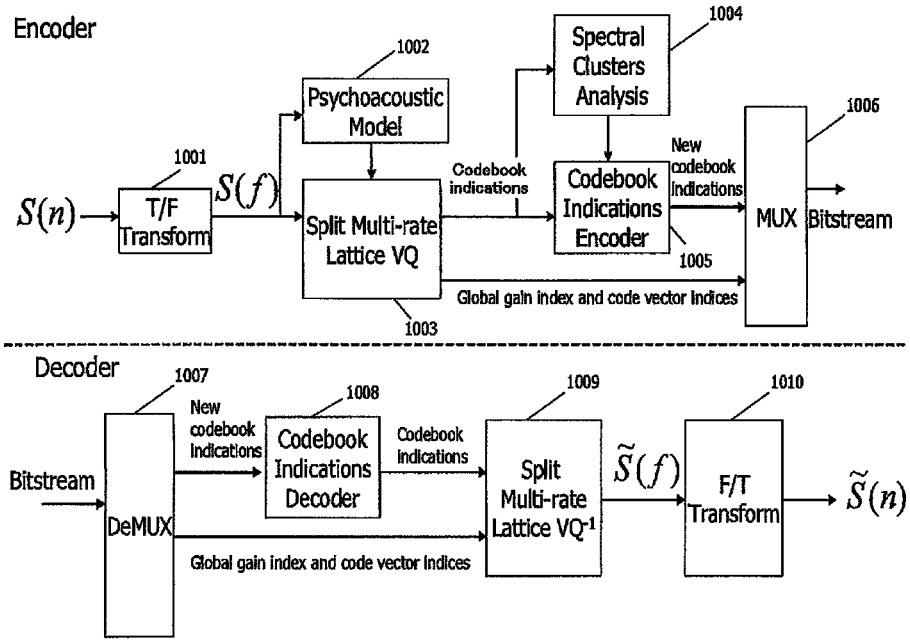
FIG. 10 illustrates the proposed framework on transform codec.

FIG. 10 illustrates the invented codec, which comprises an encoder and a decoder that apply the invented scheme on the split multi-rate lattice vector quantization.

In the encoder illustrated in FIG. 10, the time domain signal S(n) is transformed into frequency domain signal S(f) using time to frequency transformation method (1001), such as Discrete Fourier Transform (DFT) or Modified Discrete Cosine Transform (MDCT).

Psychoacoustic model analysis is done on the frequency domain signal S(f) to derive the masking curve (1002). Split multi-rate lattice vector quantization is applied on the frequency domain signal S(f) according to the masking curve derived from the psychoacoustic model analysis to ensure that the quantization noise is inaudible (1003).

The split multi-rate lattice vector quantization has three sets of quantization parameters: the quantization index of the global gain, and codebook indications and code vector indices.

The codebook indications are sent for spectral clusters analysis (1004). The spectral sparseness information is extracted by the spectral clusters analysis, and it is used to convert the codebook indications to another set of codebook indications (1005).

The global gain index, the code vector indices and the new codebook indications are multiplexed (1006) and transmitted to the decoder side.

In the decoder illustrated in FIG. 10, at the start, all the bit stream information is de-multiplexed at (1007).

The new codebook indications are used to decode the original codebook indications (1008). The global gain index, the code vector indices and the original codebook indications are dequantized by the split multi-rate lattice vector dequantization method (1009) to reconstruct the decoded frequency domain signal $\tilde{S}(f)$.

The decoded frequency domain signal $\tilde{S}(f)$ is transformed back to time domain, to reconstruct the decoded time domain signal $\tilde{S}(n)$ using frequency to time transformation method (1010), such as Inverse Discrete Fourier Transform (IDFT) or Inverse Modified Discrete Cosine Transform (IMDCT).

Figure 11:
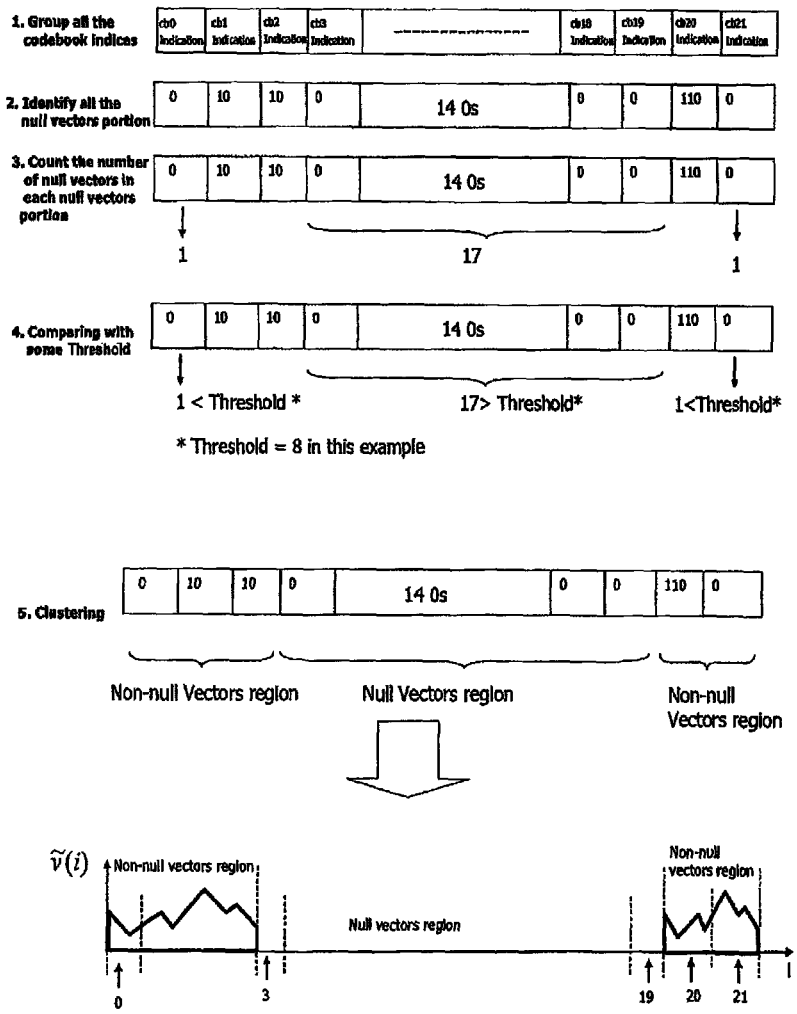
FIG. 11 illustrates the detail implementation of spectral cluster analysis.
Figure 12:
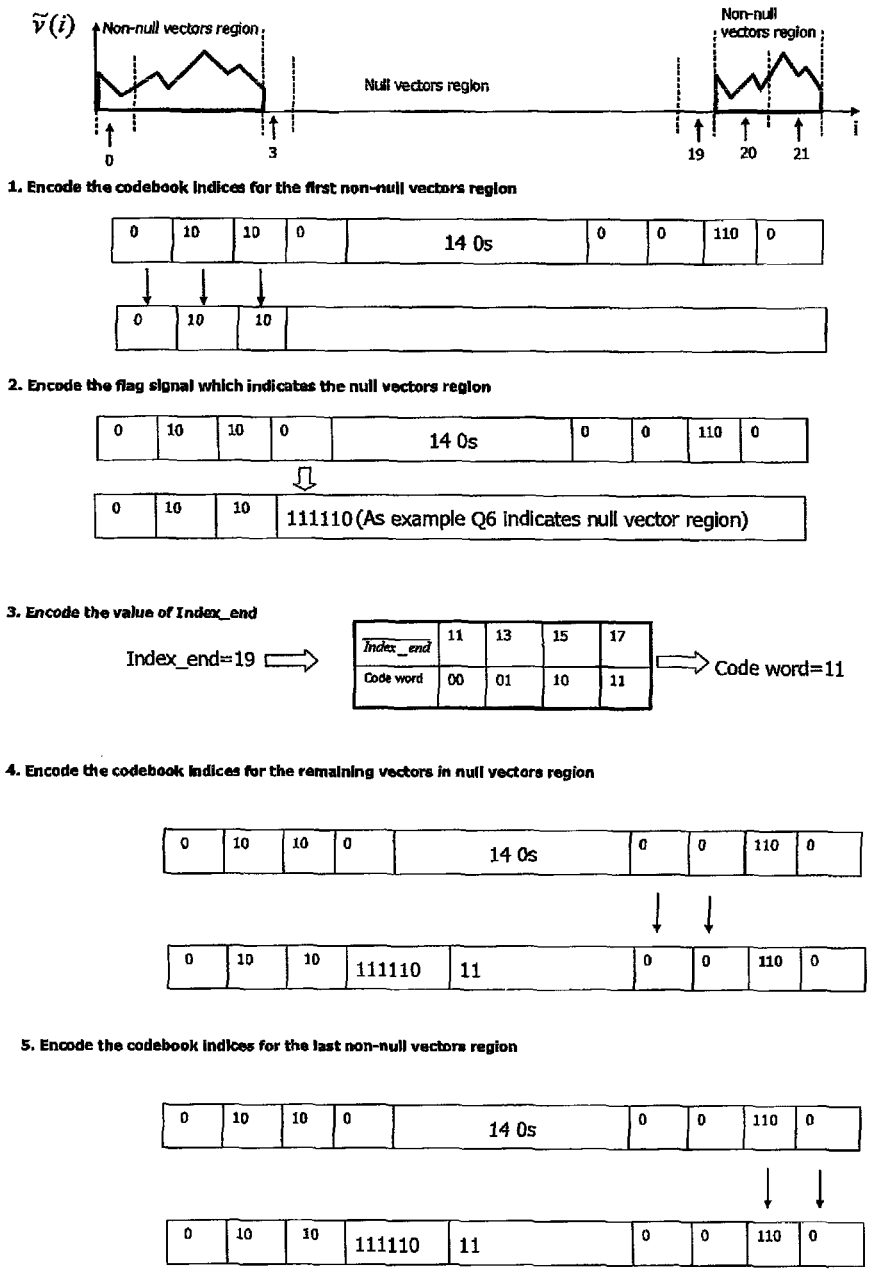
FIG. 12 illustrates the detail implementation of codebook indications encoding.

The proposed implementation method of spectral clusters analysis and codebook indications encoder is illustrated in FIG. 11 and FIG. 12.

In FIG. 11, the proposed implementation method for spectral clusters analysis is illustrated.

In this method, there are 5 steps, and each step is illustrated with figures. In this illustration, suppose that there are in total 22 vectors and the vector index starts from 0 and ends at 21.

1) Group all the codebook indications for the 22 vectors. As the vectors which are quantized by codebook Q0 are the null vectors. The spectral sparseness information can be extracted by analysis on the codebook indications of the vectors.
2) Identify all the null vectors portions. The null vectors portion is the portion which only consists of null vectors. In the example, there are 3 null vectors portion (i=0, 3-19, 21).
3) Count the number of null vectors in each null vectors portion. In the example, the first portion has only 1 null vector. The second portion has 17 null vectors and the last portion has 1 null vector.
4) Comparing the number of null vectors in each null vectors portion with Threshold. Threshold is determined by the equation below:

$$\text{Threshold}=\text{Bits}_{null_vectors_region}=\text{Bits}_{dication}+\text{Bits}_{Index_end} \quad \text{(Equation 10)}$$

where $\text{Bits}_{null_vectors_region}$ is the total bits consumption to encode the null vectors region $\text{Bits}_{indicaiton}$ is the bits consumption to inidcate the null vectors region $\text{Bits}_{Index_end}$ is the bits consumption to encode the ending index of the null vectors region In this example, since 6 bits and 2 bits are assigned to $\text{Bits}_{indicattion}$ and $\text{Bits}_{index_end}$, respectively, the bits consumption for the new encoding scheme is 8 (the detailed explanation can be found below). Therefore, Threshold is 8. For the three null vectors portions in this example, the number of null vectors in the first portion and third portion are less than Threshold. The number of null vectors in the second portion is larger than Threshold.

5) Clustering. If the number of null vectors in the null vectors portion is larger than Threshold, it is classified as null-vectors region. Otherwise, the null vectors and neighbouring non-null vectors are combined and classified as non-null vectors region. In the example, the second null vectors portion is classified as null vectors region. And the first portion and the third portion and their neighbouring non-null vectors are combined and classified as non-null vectors region. This spectrum can be simplified as three regions, two non-null vectors region and one null vectors region.

In FIG. 12, the proposed implementation method for the codebook indications encoding is illustrated. In this method, there are 5 steps, and each step is illustrated with figures. In this illustration, the spectrum in FIG. 11 is still used as example.

1) Encode the codebook indications for the first non-null vectors region. For the non-null vectors region, the codebook indications for the vectors are retained same as before.
2) Assign the identification code which indicates the null vectors region. For the null vectors region, instead of transmitting Q0 indication for each null vector, an indication of null vectors region and the ending index of the null vectors region are transmitted. In this example, the 6-bit indication (111110) is utilized to indicate the null vectors region.
3) Encode the value of Index_end, which is the index of the ending vector for the null vector region. In this example, the Index_end is quantized by a 2 bit codebook which consists of 4 representative values. Each representative value represents a possible value of the Index_end. For this example, the representative values are shown in the table. And the detail determination of this table will be explained in the later part.
4) Encode the codebook indications for the remaining vectors in the null vectors region. In most of the cases, the quantized Index_end doesn't exactly equal to the real Index_end. Therefore, it is necessary to encode the remaining vectors in the null vectors region. For the remaining vectors, the codebook indications are assigned as Q0 indication.
5) Encode the codebook indications for the last non-null vectors region. For the non-null vectors region, the codebook indications for the vectors are retained same as before.

In FIG. 13, the indication table of the conventional split multi-rate lattice VQ and the indication table of the invented method are shown.

From these two tables, it can be seen that the indication of the null vectors region utilizes the indication of the $Q_6$ codebook indication. 2 bit codebook is used to quantize the possible Index_end. Therefore, for the null vectors region, the total bits consumption is 8. And for the codebooks $Q_n$ ($n \geq 6$), they use the indication of $Q_{n+1}$ ($n \geq 6$), means that their bits consumption is one bit higher than original indication.

Figure 14:
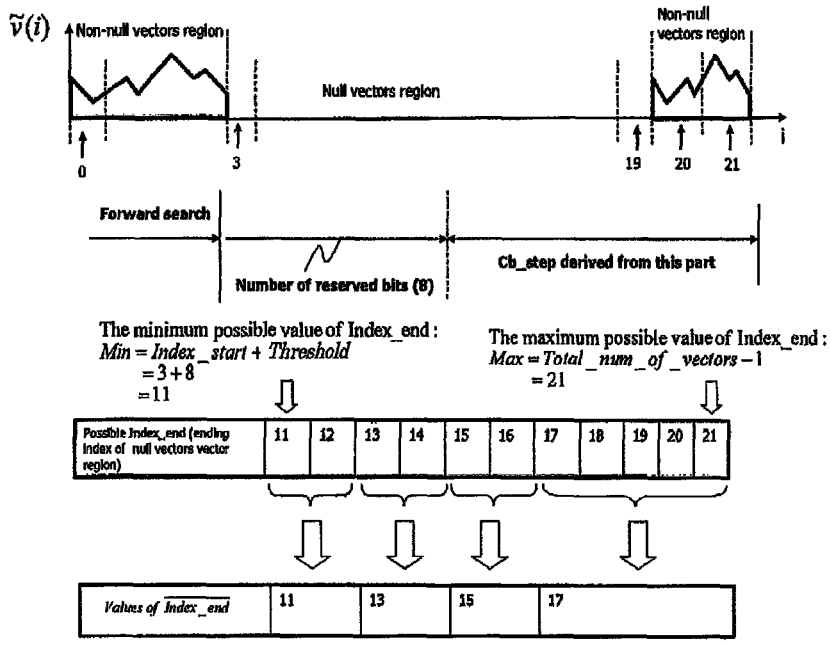
FIG. 14 illustrates the detail implementation of code vectors determination.
Figure 15:
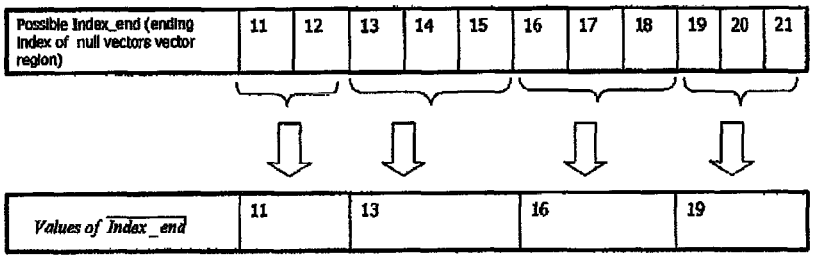
FIG. 15 illustrates another method of code vectors determination.

FIGS. 14 and 15 show two examples on how the 2 bit codebook is determined.

FIG. 14 continues with the spectrum utilized in FIG. 11. As shown in the figure, the Index_start is 3, the total number of vectors in the spectrum is 22, and Threshold for null vectors region is 8. The range of possible values of the Index_end is from 11 to 21 (21 means all the vectors after Index_start are null vectors).

In order to quantize the Index_end using a 2 bit codebook, the representative values are determined adaptively according to the range of the possible values of Index_end. The range for the possible value of Index_end is split to 4 portions. Each portion is represented by one representative value. The step (number of null vectors) of each portion is determined by the equation below:

$$cb_step = \lfloor (Max - Min + 1)/4 \rfloor = \lfloor (21 - 11 + 1)/4 \rfloor = 2 \quad \text{(Equation 11)}$$

where cb_step means the average number of values in each portion

Max is the maximum possible value of Index_end

Min is the minimum possible value of Index_end

The representative value is determined by the equation below:

$$\overline{Index_end} = Index_start + Threshold + cv * cb_step \quad \text{(Equation 12)}$$

$cv \in \{0, 1, 2, 3\}$ where

Index_start is the index of the starting vector of the null vectors region

Index_end is the index of the ending vector of the null vectors region

Threshold is the threshold to judge the null vectors region cv is the code vector to represent the value of Index_end cb_step is the number of values in each portion $\overline{Index_end}$ is the quantized value of Index_end In this example, the total bits consumption to encode all the codebook indications by original method is:

$$\begin{aligned} Bits_{cb_original} &= \sum_{i=0}^{N-1} Bits_{cb_indication}(i) \\ &= \sum_{i=0}^{Index_start-1} Bits_{cb_indication}(i) + \\ &\quad \sum_{i=Index_end+1}^{N-1} Bits_{cb_indication}(i) + \\ &\quad (Index_end - Index_start + 1) \\ &= 26 \end{aligned} \quad \text{(Equation 13)}$$

where $Bits_{cb_original}$ is the total bits consumption for all the codebook indications $Bits_{cb_indication}$ is the bits consumption for the codebook indication for each vector N is the total number of vectors in the whole spectrum Index_start is the index of the starting vector of the null vectors region Index_end is the index of the ending vector of the null vectors region In this example, the total bits consumption to encode all the codebook indications by the invented method is:

$$\begin{aligned} Bits_{cb_new} &= \sum_{i=0}^{Index_start-1} Bits_{cb_indication}(i) + \\ &\quad \sum_{i=\overline{Index_end}+1}^{N-1} Bits_{cb_indication}(i) + \\ &\quad Bits_{indication} + Bits_{\overline{Index_end}} \\ &= 5 + 6 + 8 \\ &= 19 \end{aligned} \quad \text{(Equation 14)}$$

where $Bits_{cb_new}$ is the total bits consumption for all the codebook indications by the proposed method $Bits_{cb_indication}$ is the bits consumption for the codebook indication for each vector N is the total number of vectors in the whole spectrum $Bits_{indicaiton}$ is the bits consumption to inidcate the null vectors region $Bits_{\overline{index_end}}$ is the bits consumption to encode the quantized ending index of the null vectors region Index_start is the index of the starting vector of the null vectors region Index_end is the index of the ending vector of the null vectors region $\overline{\text{Index_end}}$ is the quantized value of Index_end The bits saving by the method proposed in this invention is calculated as following:

$$\begin{aligned} Bits_{save} &= Bits_{cb_original} - Bits_{cb_new} \\ &= (\overline{\text{Index_end}} - \text{Index_start} + 1) - \\ &\quad Bits_{indication} - Bits_{\overline{Index_end}} \\ &= 7 \end{aligned} \quad \text{(Equation 15)}$$

where $Bits_{cb_new}$ is the total bits consumption for all the codebook indications by the proposed method $Bits_{cb_original}$ is the total bits consumption for all the codebook indications by the original method $Bits_{indicaiton}$ is the bits consumption to inidcate the null vectors region $Bits_{\overline{Index_end}}$ is the bits consumption to encode the quantized ending index of the null vectors region Index_start is the index of the starting vector of the null vectors region Index_end is the index of the ending vector of the null vectors region $\overline{\text{Index_end}}$ is the quantized value of Index_end FIG. 15 is another way to calculate the step of the code vectors (In this document, 'code vector' having scalar value is also denoted as 'representative value').

The step (number of null vectors) of each portion is determined by the equation below:

$$\text{cb_step}=(\text{Max}-\text{Min}+1)/4=(21-11+1)/4=2.75 \quad \text{(Equation 16)}$$

where cb_step means the average number of values in each portion

Max is the maximum possible value of Index_end

Min is the minimum possible value of Index_end

The value of Index_end which is represented by the code vector is determined by the equation below:

$$\overline{\text{Index_end}}=\text{Index_start}+\text{Threshold}+\lfloor cv*Cb_\text{step}\rfloor \quad \text{(Equation 17)}$$

$cv \in \{0, 1, 2, 3\}$ where Index_start is the index of the starting vector of the null vectors region Index_end is the index of the ending vector of the null vectors region Threshold is the threshold to judge the null vectors region cv is the code vector to represent the value of Index_end cb_step is the number of values in each portion $\overline{\text{Index_end}}$ is the quantized value of Index_end In this example, the total bits consumption to encode all the codebook indications by original method is:

$$Bits_{cb_original} = \sum_{i=0}^{N-1} Bits_{cb_indication}(i) \quad \text{(Equation 18)}$$

-continued $$\begin{aligned} &= \sum_{i=0}^{Index_start-1} Bits_{cb_indication}(i) + \\ &\quad \sum_{i=Index_end+1}^{N-1} Bits_{cb_indication}(i) + \\ &\quad (\text{Index_end} - \text{Index_start} + 1) \\ &= 26 \end{aligned}$$

where $Bits_{cb_original}$ is the total bits consumption for all the codebook indications $Bits_{cb_indication}$ is the bits consumption for the codebook indication for each vector N is the total number of vectors in the whole spectrum Index_start is the index of the starting vector of the null vectors region Index_end is the index of the ending vector of the null vectors region In this example, the total bits consumption to encode all the codebook indications by the proposed method is:

$$\begin{aligned} Bits_{cb_new} &= \sum_{i=0}^{Index_start-1} Bits_{cb_indication}(i) + \\ &\quad \sum_{i=\overline{Index_end}+1}^{N-1} Bits_{cb_indication}(i) + \\ &\quad Bits_{indication} + Bits_{\overline{Index_end}} \\ &= 5 + 6 + 6 \\ &= 17 \end{aligned} \quad \text{(Equation 19)}$$

where $Bits_{cb_new}$ is the total bits consumption for all the codebook indications by the proposed method $Bits_{cb_indication}$ is the bits consumption for the codebook indication for each vector N is the total number of vectors in the whole spectrum $Bits_{indicaiton}$ is the bits consumption to inidcate the null vectors region $Bits_{\overline{Index_end}}$ is the bits consumption to encode the quantized ending index of the null vectors region Index_start is the index of the starting vector of the null vectors region Index_end is the index of the ending vector of the null vectors region $\overline{\text{Index_end}}$ is the quantized value of Index_end The bits saving by the method proposed in this invention is calculated as following:

$$\begin{aligned} Bits_{save} &= Bits_{cb_original} - Bits_{cb_new} \\ &= (\overline{\text{Index_end}} - \text{Index_start} + 1) - \\ &\quad Bits_{indication} - Bits_{\overline{Index_end}} \\ &= 9 \end{aligned} \quad \text{(Equation 20)}$$

where $Bits_{cb_new}$ is the total bits consumption for all the codebook indications by the proposed method $Bits_{cb_original}$ is the total bits consumption for all the codebook indications by the original method $Bits_{indicaiton}$ is the bits consumption to inidcate the null vectors region $Bits_{\overline{Index_end}}$ is the bits consumption to encode the quantized ending index of the null vectors region Index_start is the index of the starting vector of the null vectors region Index_end is the index of the ending vector of the null vectors region $\overline{Index_end}$ is the quantized value of Index_end The methods to determine the code vectors are not limited to the examples given above. Those who are skilled in the art will be able to modify and adapt other methods without deviating from the spirit of the invention.

In this embodiment, by doing spectral analysis on the split multi-rate vector quantized spectrum, the spectrum is split to null vectors region and non-null vectors region.

For the null vectors region, instead of transmitting Q0 indication for null vectors, an indication of null vectors region and the quantized value of the index of the ending vector (denoted as ending index) of the null vectors region are transmitted.

The indication of null vectors region uses one of the codebook indications which are not used so frequently. The original codebook is indicated by other indication.

The ending index is quantized by an adaptively designed codebook. All the possible values of the ending index are split to a few portions, the length of each portion is adaptively determined according to the total number of possible values of the ending index. Each portion is represented by one of the representative value in the codebook.

Therefore, bits saving are achieved by applying the inventive method for consecutive null vectors.

Furthermore, in this embodiment, the value of ending index is quantized by a codebook whose number of representative values is denoted as N. The range of the possible values of the ending index is split to N portions. The minimum value in each portion is selected as the representative value of the portion.

Therefore, there is also an advantage that the bits consumption for the codebook of the ending index is fixed. But the representative values are adaptively determined according to the range of the possible values of the ending index, which can efficiently quantize the ending index for different scenarios.

Figure 16:
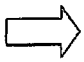
FIG. 16 shows another method of null vectors indication.

Furthermore, as shown in FIG. 16, both the indication of the null vectors region and Q6 utilize the same indication, but one more bit is appended to differentiate null vectors region and Q6. All other codebook indications don't change.

In this case, the indication of null vectors region uses one of the codebook indications which are not used frequently. And one more bit is utilized to indicate whether it is null vectors region or original codebook indication.

Therefore, there is an advantage that only one codebook indication is affected while all other codebooks remain same. If the indication is chosen appropriately (it is not used very frequently as codebook indication). More bits can be saved.

(Embodiment 2)

When the null vectors region is in the lower frequency range, instead of quantization of the ending index, the starting index (the index of the starting vector in the null vectors region) is quantized. The bit stream is reversed, so that the ending index is known in decoder side. It is preferable to compare the bits saving between the quantization of the starting index and quantization of the ending index, so that the method which saves more bits can be utilized.

Figures 17, 18:
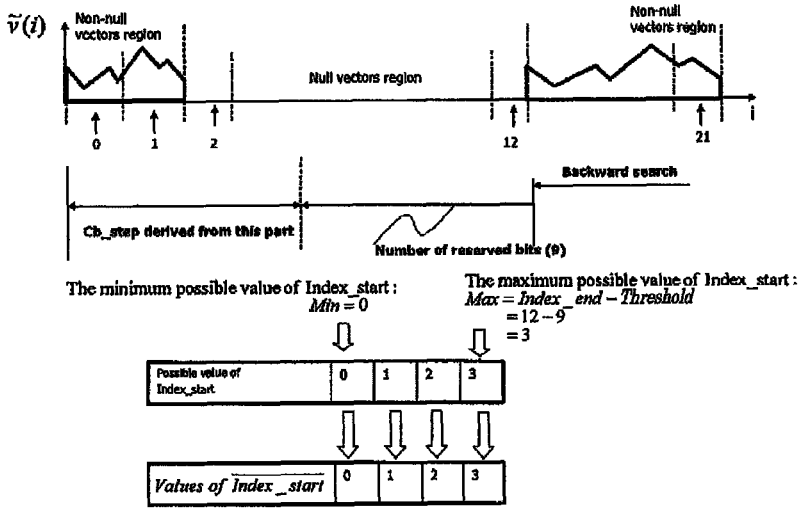
FIG. 17 illustrates the idea of backward searching.
FIG. 18 shows the indication table for backward searching.

As shown in FIG. 17, the null vectors region lies in lower frequency range, if the Cb_step is determined by forward searching which is illustrated in embodiment 1.

$$\begin{aligned} Min &= Index_start + Threshold \\ &= 2 + 8 \\ &= 10 \end{aligned} \quad \text{(Equation 21)}$$

$$\begin{aligned} Max &= Total_num_of_vectors - 1 \\ &= 21 \end{aligned} \quad \text{(Equation 22)}$$

$$cb_step = \frac{(Max - Min + 1)}{4} = \frac{(21 - 10 + 1)}{4} = 3 \quad \text{(Equation 23)}$$

where cb_step means the average number of values in each portion

Max is the maximum possible value of Index_end

Min is the minimum possible value of Index_end

Index_start is the index of the starting vector of the null vectors region

Index_end is the index of the ending vector of the null vectors region

Threshold is the threshold to decide whether a null vectors portion is the null vectors region The representative value is determined by the equation below:

$$\overline{Index_end} = Index_start + Threshold + cv * Cb_step \quad \text{(Equation 24)}$$

$cv \in \{0,1,2,3\}$ $$\overline{Index_end} \in \{10,13,16,19\} \quad \text{(Equation 25)}$$

where

Index_start is the index of the starting vector of the null vectors region $\overline{Index_end}$ is the quantized value of the index of the ending vector of the null vectors region Threshold is the threshold to judge the null vectors region cv is the code vector to represent the value of Index_end cb_step is the number of values in each portion Because the Cb_step is very large, the difference between the neighbouring values of $\overline{Index_end}$ is very large.

For some conditions, the error between the quantized value and the real value of Index_end is large too. In this example, $$Index_end = 12$$

$$\overline{Index_end} = 10$$

$$Error_{fs} = Index_end - \overline{Index_end} = 2 \quad \text{(Equation 26)}$$

where,

Index_end is the index of the ending vector of the null vectors region $\overline{Index_end}$ is the quantized value of the index of the ending vector of the null vectors region $Error_{fs}$ is the quantization error of the Index_end Therefore, a method which quantizes the starting index instead of the ending index is proposed, and the series of codebook indications will be reversed to notify the value of Index_end to the decoder.

For the example in FIG. 17, $$Index_start = 2$$

$$Index_end = 12$$

$$Threshold = Bits_{null_vectors_region} = Bits_{indication} + Bits_{Index_start} = 9 \quad \text{(Equation 27)}$$

$$Min=0;$$

$$Max=Index_end-Threshold=3 \quad \text{(Equation 28)}$$

where, cb_step means the average number of values in each portion

Max is the maximum possible value of Index_start

Min is the minimum possible value of Index_start

Index_start is the index of the starting vector of the null vectors region

Index_end is the index of the ending vector of the null vectors region

Threshold is the threshold to decide whether a null vectors portion is the null vectors region $Bits_{null_vectors_region}$ is thetotal bits consumption to encode the null vectors region $Bits_{indicaiton}$ is the bits consumption to inidcate the null vectors region, in this example 7 bits is consumed $Bits_{Index_start}$ is the bits consumption to encode the starting index of the null vectors region, in this example 2 bits is consumed.

The cb_step and the representative values of Index_start, $\overline{Index_start}$, can be determined by one of two methods below:

Method 1:

$$cb_step=\lfloor(Max-Min+1)/4\rfloor=\lfloor(3-0+1)/4\rfloor=1 \quad \text{(Equation 29)}$$

$$\overline{Index_start}=Index_end-Threshold-cv*cb_step \quad \text{(Equation 30)}$$

$cv \in \{0,1,2,3\}$ $$\overline{Index_start} \in \{0,1,2,3\} \quad \text{(Equation 31)}$$

where,

Index_end is the index of the ending vector of the null vectors region $\overline{Index_start}$ is the quantized value of the index of the starting vector of the null vectors region Threshold is the threshold to judge the null vectors region cv is the code vector to represent the value of Index_end cb_step is the number of values in each portion Method 2:

$$cb_step=(Max-Min+1)/4=(3-0+1)/4=1 \quad \text{(Equation 32)}$$

$$\overline{Index_start}=Index_end-threshold-\lfloor cv*cb_step\rfloor \quad \text{(Equation 33)}$$

$cv \in \{0,1,2,3\}$ $$\overline{Index_start} \in \{0,1,2,3\} \quad \text{(Equation 34)}$$

where

Index_end is the index of the ending vector of the null vector sregion $\overline{Index_start}$ is the quantized value of the index of the starting vector of the null vector sregion threshold is the threshold to judge the null vectors region cv is the code vector to represent the value of Index_end cb_step is the number of values in each portion From equation 31 and equation 34, it can be seen that the $\overline{Index_start}$ have the same set of values by the above two methods. In this example, The Cb_step and the representative values of Index_start, $\overline{Index_start}$, can be determined by one of two methods below:

$$Index_start=2$$

$$\overline{Index_start}=2$$

$$Error_{bs}=Index_start-\overline{Index_start}=0 \quad \text{(Equation 35)}$$

where,

Index_start is the index of the starting vector of the null vectors region $\overline{Index_start}$ is the quantized value of the index of the starting vector of the null vectors region $Error_{bs}$ is the quantization error of the Index_start The method in embodiment 1 is named as forward searching as it determines the Cb_step by Index_start and total number of vectors. The method in this embodiment is named as backward searching as it determines the Cb_step by Index_end.

Although one more bit (9 bits for indication of backward searching, 8 bits for the indication of forward searching) is consumed to indicate the backward searching method, there is one more bit saved by the backward searching method comparing to forward searching method.

$$Bits_{save_{bs}}=Error_{fs}-Error_{bs}-1=1 \quad \text{(Equation 36)}$$

where, $Bits_{save_bs}$ is the bits saving for backward searching comparing with forward searching $Error_{fs}$ is the quantization error of the Index_end in forward searching $Error_{bs}$ is the quantization error of the Index_start in backward searching In FIG. 18, the indication table of the conventional split multi-rate lattice VQ and the indication table of the proposed method are shown.

In the codebook table for inventive method, the forward searching indication is not changed. And the backward searching is indicated by adding one 0 in front of the forward searching. This indication would not be misinterpreted as Q0+forward searching (0+111110) as it is not possible to have a null vector before the null vectors region.

Figures 19, 20:
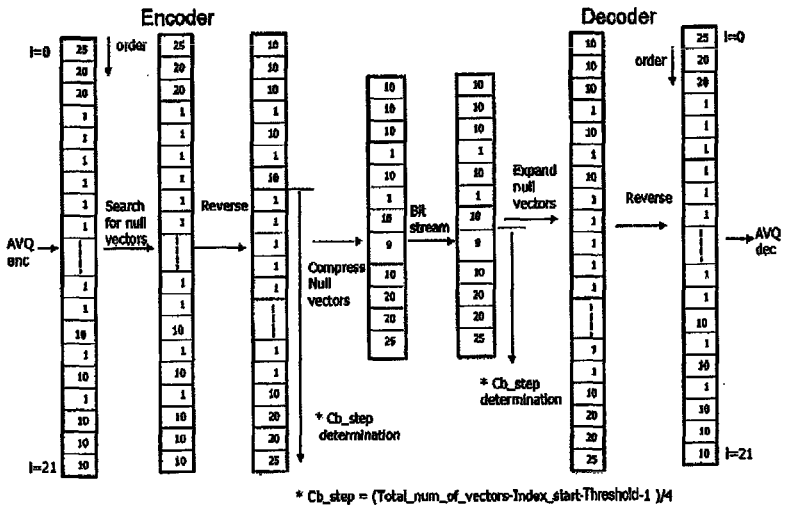
FIG. 19 illustrates the detail implementation of backward searching.
FIG. 20 shows another indication table which consumes fewer bits.

FIG. 19 shows the detail steps of the backward searching method. In the backward searching method, there are 4 steps:

1) Search for the null vectors region in the list of the codebook indices

2) Compare the bits saving against the forward searching after the null vectors region is identified. And the method which achieves more bits saving is selected.

3) After it is confirmed that backward searching should be utilized, the list of the codebook indications is reversed and Cb_step is determined as the method illustrated in the forward searching in the main embodiment.

4) Compress the list of the codebook indications by the proposed method in this invention.

In the decoder side, there are 3 steps to reconstruct the list of the codebook indications.

1) Determine the Cb_step same as forward searching.

2) Expand the null vectors by inverse the operation done in the encoder side.

3) Reverse the list of codebook indications if the indication shows that the backward searching is used.

In this embodiment, when the null vectors region is in the lower frequency range, instead of quantization of the ending index, the starting index (the index of the starting vector in the null vectors region) is quantized. The bit stream is reversed, so that the ending index is known in decoder side. It is preferable to compare the bits saving between the quantization of the starting index and quantization of the ending index, so that the method which saves more bits can be utilized. Therefore, more bits saving can be achieved.

(Embodiment 3)

In embodiment 2, the reverse operation requires more computational power. In this embodiment, a method which requires no reversal of the list of the codebook indications is proposed.

For backward searching method, the Cb_step is calculated in the following equation:

$$cb_step-\lfloor(Index_end-8)/4\rfloor \quad \text{(Equation 37)}$$

where

Index_end is the index of the ending vector of the null vectors region cb_step is the number of values in each portion The number of the null vectors in the null vectors region is calculated as the following equation:

$$no_null-10+cv*cb_step \quad \text{(Equation 38)}$$

$cv \in \{0,1,2,3\}$ where cv is the code vector to represent the value of Index_end cb_step is the number of values in each portion no_null is the number of null vectors in the null vector region From equations 37 and 38, the following equation can be derived $$Index_end-Index_start+1=10+cv*\lfloor(Index_end-8)/4\rfloor \quad \text{(Equation 39)}$$

Here, if 'Index_end−8' is multiples of 4, then equation (39) is modified to equation (43) in a few steps:

$$(Index_end-8)*4-(Index_start+1)*4=cv*(Index_end-8) \quad \text{(Equation 40)}$$

$$\frac{Index_start+1}{Index_end-8}=\frac{4-cv}{4} \quad \text{(Equation 41)}$$

$$\frac{Index_end-9-Index_start}{Index_start+1}=\frac{cv}{4-cv} \quad \text{(Equation 42)}$$

$$no_null=(Index_start+1)*\frac{cv}{4-cv}+10 \quad \text{(Equation 43)}$$

where cv is the code vector to represent the value of Index_end cb_step is the number of values in each portion no_null is the number of null vectors in the null vector region Index_start is the index of the starting vector of the null vectors region Index_end is the index of the ending vector of the null vectors region From equation 43, it is possible to design the values of cv/(4−cv) so that number of null vectors can be derived from the value of Index_start.

The set of coefficients can be defined as $$\frac{cv}{4-cv}\in\left\{0,\frac{1}{2},1,\frac{3}{2}\right\} \quad \text{(Equation 44)}$$

where cv is the code vector to represent the value of Index_end as an example.

In this embodiment, instead of reversing the bit stream, the number of null vectors is quantized as a scalar multiplies the value of starting index. It is preferable to train the scalars before hand and each scalar is represented by one of the code vectors in the codebook. There is an advantage that bit stream reversal can be avoided and complexity is reduced in this embodiment.

(Embodiment 4)

In this embodiment, it is possible to reduce the bits consumption according to the range of the possible values of the Index_end.

FIG. 20 shows the new indication table, the total bits required for the representation of the null vectors region can be 6 or 7 or 8 bits instead of constantly 8 bits.

FIG. 21 illustrates the conditions. For the input spectrum which has the null vectors region. The minimum possible value of the Index_end, denoted as Min, is:

$$Min=Index_start+Threshold \quad \text{(Equation 45)}$$

where

Min is the minimum possible value of Index_end

Index_start is the index of the starting vector of the null vectors region

Index_end is the index of the ending vector of the null vectors region

Threshold is the threshold to decide whether a null vectors portion is the null vectors region The maximum possible value of the Index_end, denoted as Max, is:

$$Max=Total_num_of_vectors-1 \quad \text{(Equation 46)}$$

where

Max is the maximum possible value of Index_end

Total_num_of_vectors is the total number of vectors in the spectrum

Then the range of the possible values of the Index_end is from Min to Max.

If we define Length as the total number of possible values of Index_end, according to the value of length, there are 4 different cases:

Case 1: Min=Max, Length=1

No bit is required to indicate the value of Index_end as there is only one possibility.

Total bits consumption=6

Case 2: Min=Max−1, Length=2

One bit is required to indicate the value of Index_end as there are only two possibilities.

Total bits consumption=6+1=7

Case 3: Min=Max−2, Length=3

Two bits are required to indicate the value of Index_end as there are three possibilities.

Total bits consumption=6+2=8

Case 4: Min<Max−2, Length>3

The values of the Index_end are to be quantized by 2 bit codebook (which has 4 representative values). All the possible value of Index_end is split to 4 portions.

Each portion is represented by one representative value.

Total bits consumption=6+2=8

In this embodiment, according to the number of possible values of ending index, the number of bits to represent the code vectors is adaptively decided. Such as if the length of possible number of null vectors is 1, and then no bit is required to indicate the number of null vectors. There is an advantage that more bits can be saved in this embodiment.

(Embodiment 5)

For the indication method of the null vectors region in the embodiment 1, each codebook indication for Qn(n≥6) consumes one more bit comparing with conventional method. If the input signal has M vectors which quantized by Qn(n≥6), and has no null vectors region, then M more bits are wasted on the codebook indication comparing with conventional method.

In this embodiment, a more efficient indication method for the null vectors region is proposed.

As shown in FIG. 22, in this embodiment, there are two indication tables are utilized. Table 1 is the conventional indication table and table 2 is the null vectors indication table in the embodiment 1. One bit is consumed to indicate which table is used for the whole spectrum, so that even the input signal has M (M>1) vectors which quantized by Qn(n≥6), and has no null vectors region, the maximum number of bit wasted comparing to conventional method is 1 bit only.

In FIG. 23, the input frames are classified to 3 cases.

Case 1: No vector using codebook Qn(n 6) and no null vectors region exists when index<=Total_num_of_vectors−Threshold Table 1 is used and no indication is required to indicate the indication table Case 2: Null vectors region exist when index<=Total_num_of_vectors−Threshold Table 2 is used and indication is done on the first vectors whose codebook is higher than Q5. It is preferable to ensure that the bits save achieved by null vectors representation is larger than bits increment caused by vectors which use codebook Qn(n≥6)

Case 3: Null vectors region doesn't exist, but some vectors using codebook>Q5 when index<=Total_num_of_vectors−Threshold

Table 1 is used and indication is done on the first vector whose codebook is higher than Q5

For the null vectors region indication in this embodiment, two indication tables are utilized. For the frames which have no null vectors region, conventional indication table is utilized.

For the frames which have null vectors region, the null vectors region indication table is utilized. One bit is consumed to indicate which table is utilized when necessary. In this embodiment, the bits waste to indicate the higher codebooks for the frames which have no null vectors region is limited to 1 bit.

(Embodiment 6)

For the frames which have the null vectors region up to the last vector, a specific indication is used. So that the errors for the number of null vectors caused by the Cb_step can be avoided The indication table is shown in the FIG. 24. For the frames which have the null vectors region up to the last vector, the indication 00111110 is used to indicate. And no more bits required to indicate the value of the Index_end.

In this embodiment, for the frames which have the null vectors region up to the last vector, a specific indication is used, so that the quantization error of the ending index can be avoided. Therefore, there is an advantage that more bits can be saved for the frames which have the null vectors region up to the last vector.

(Embodiment 7)

The feature of this embodiment is the invented methods are applied in TCX codec.

Figure 25:
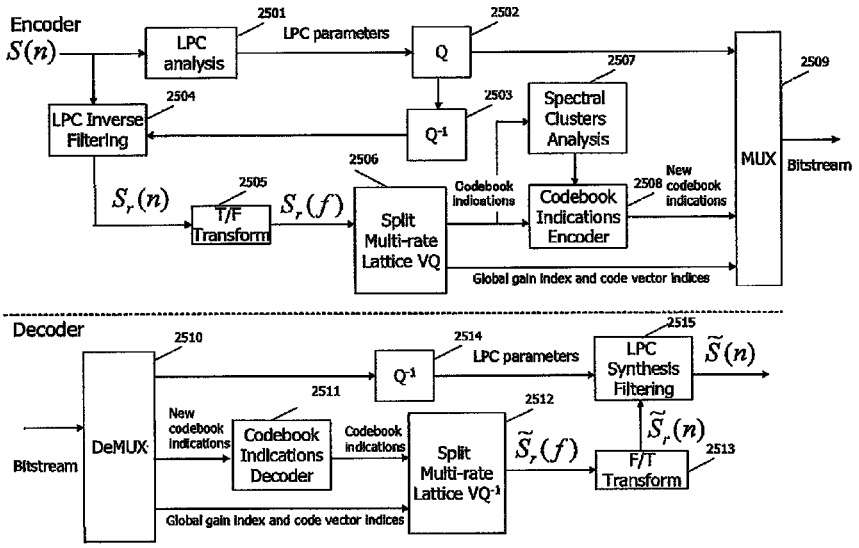
FIG. 25 illustrates the proposed framework on TCX codec.

The proposed idea is illustrated in FIG. 25.

In the encoder illustrated in FIG. 25, LPC analysis is done on the input signal to exploit the predictable nature of signals in time domain (2501). The LPC coefficients from the LPC analysis are quantized (2502), the quantization indices are multiplexed (2509) and transmitted to decoder side. With the quantized LPC coefficients from dequantization module (2503), the residual (excitation) signal $S_r(n)$ is obtained by applying LPC inverse filtering on the input signal S(n) (2504).

The residual signal $S_r(n)$ is transformed into frequency domain signal $S_r(f)$ using time to frequency transformation method (2505), such as Discrete Fourier Transform (DFT) or Modified Discrete Cosine Transform (MDCT).

Split multi-rate lattice vector quantization is applied on the frequency domain signal $S_r(f)$ (2506).

The split multi-rate lattice vector quantization has three sets of quantization parameters: the quantization index of the global gain, and codebook indications and code vector indices.

The codebook indications are sent for spectral clusters analysis (2507). The spectral sparseness information is extracted by the spectral clusters analysis, and it is used for convert the codebook indications to another set of codebook indications (2508).

The global gain index, the code vector indices and the new codebook indications are multiplexed (2509) and transmitted to the decoder side.

In the decoder illustrated in FIG. 25, at the start, all the bitstream information is de-multiplexed at (2510).

The new codebook indications are used to decode the original codebook indications (2511). The global gain index, the code vector indices and the original codebook indications are dequantized by the split multi-rate lattice vector dequantization method (2512) to reconstruct the decoded frequency domain signal $\tilde{S}_r(f)$.

The decoded frequency domain residual signal $\tilde{S}_r(f)$ is transformed back to time domain, to reconstruct the decoded time domain residual signal $\tilde{S}_r(n)$ using frequency to time transformation method (2513), such as Inverse Discrete Fourier Transform (IDFT) or Inverse Modified Discrete Cosine Transform (IMDCT).

With the dequantized LPC parameters from the dequantization module (2514), the decoded time domain residual signal $\tilde{S}_r(n)$ is processed by LPC synthesis filter (2515) to obtain the decoded time domain signal $\tilde{S}(n)$.

(Embodiment 8)

The feature of this embodiment is the spectral cluster analysis method is applied in hierarchical coding (layered coding, embedded coding) of CELP and transform coding.

Figure 26:
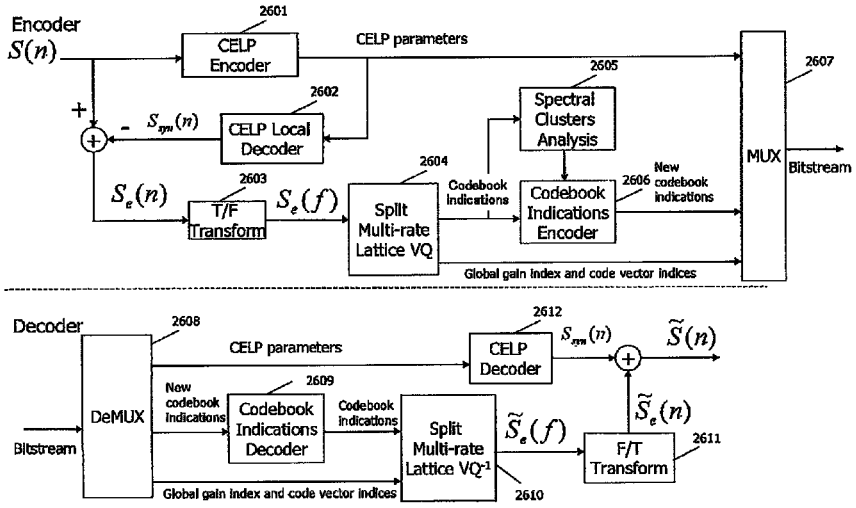
FIG. 26 illustrates the proposed framework on layer codec (CELP+transform)

In the encoder illustrated in FIG. 26, CELP encoding is done on the input signal to exploit the predictable nature of signals in time domain (2601). With the CELP parameters, the synthesized signal $S_{syn}(n)$ is reconstructed by the CELP decoder (2602), and the CELP parameters are multiplexed (2607) and transmitted to decoder side. The prediction error signal $S_e(n)$ (the difference signal between the input signal and the synthesized signal) is obtained by subtracting the synthesized signal from the input signal.

The prediction error signal $S_e(n)$ is transformed into frequency domain signal $S_e(f)$ using time to frequency transformation method (2603), such as Discrete Fourier Transform (DFT) or Modified Discrete Cosine Transform (MDCT).

Split multi-rate lattice vector quantization is applied on the frequency domain signal $S_e(f)$ (2604).

The split multi-rate lattice vector quantization has three sets of quantization parameters: the quantization index of the global gain, and codebook indications and code vector indices.

The codebook indications are sent for spectral clusters analysis (2605). The spectral sparseness information is extracted by the spectral clusters analysis, and it is used for convert the codebook indications to another set of codebook indications (2606).

The global gain index, the code vector indices and the new codebook indications are multiplexed (2607) and transmitted to the decoder side.

In the decoder illustrated in FIG. 26, at the start, all the bitstream information is de-multiplexed at (2608).

The new codebook indications are used to decode the original codebook indications (2609). The global gain index, the code vector indices and the original codebook indications are dequantized by the split multi-rate lattice vector dequantization method (2610) to reconstruct the decoded frequency domain signal $\tilde{S}_e(f)$.

The decoded frequency domain residual signal $\tilde{S}_e(f)$ is transformed back to time domain, to reconstruct the decoded time domain residual signal $\tilde{S}_e(n)$ using frequency to time transformation method (2611), such as Inverse Discrete Fourier Transform (IDFT) or Inverse Modified Discrete Cosine Transform (IMDCT).

With the CELP parameters, the CELP decoder reconstructs the synthesized signal $S_{syn}(n)$ (2612), the decoded time domain signal $\tilde{S}(n)$ is reconstructed by summing up the CELP synthesized signal $S_{syn}(n)$ and the decoded prediction error signal $\tilde{S}_e(n)$.

(Embodiment 9)

Figure 27:
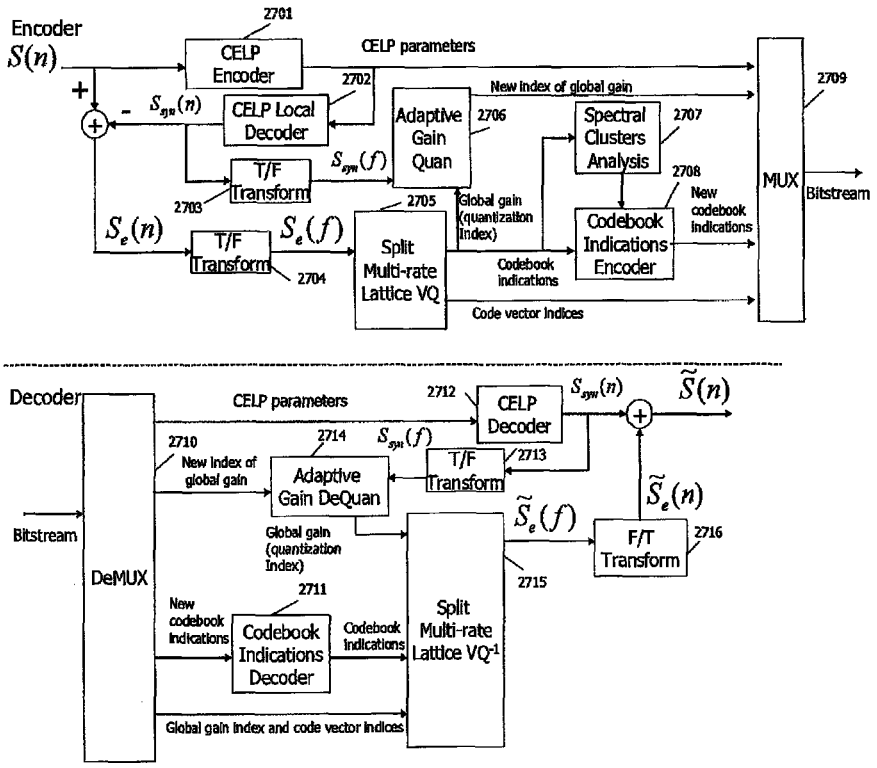
FIG. 27 illustrates the proposed framework on CELP+transform codec with adaptive gain quantization.

In this embodiment, as shown in FIG. 27, the spectral cluster analysis method is combined with an adaptive gain quantization method.

The encoding and decoding process is almost the same as in embodiment 8, except that the index of the global gain or the global gain itself from the split multi-rate is sent to adaptive gain quantization block (2706). Instead of directly quantize the global gain, the adaptive gain quantization method explores the relevancy between the synthesized signal and the coding error signal which is quantized by the split multi-rate lattice vector quantization, so that the global gain can be more efficiently quantized in a smaller range.

There are two methods to implement the AVQ gain quantization:

Method 1

Step 1: Search for the maximum absolute value syn_max of the synthesized signal $S_{syn}(f)$ Step 2: Compute the ratio of AVQ_gain/syn_max Step 3: Quantize the ratio of AVQ_gain/syn_max in a narrow downed range (It is preferable to train the narrow downed range using different signal sequences beforehand)

Method 2

Step 1: Search for the maximum absolute value syn_max of the synthesized signal $S_{syn}(f)$ Step 2: Quantize AVQ_gain, suppose index=Index1

Step 3: Quantize syn_max, suppose index=Index2

Step 4: transmit the Index2-index1 in a narrowed range (It is preferable to train the narrow downed range using different signal sequences beforehand)

Figure 28:
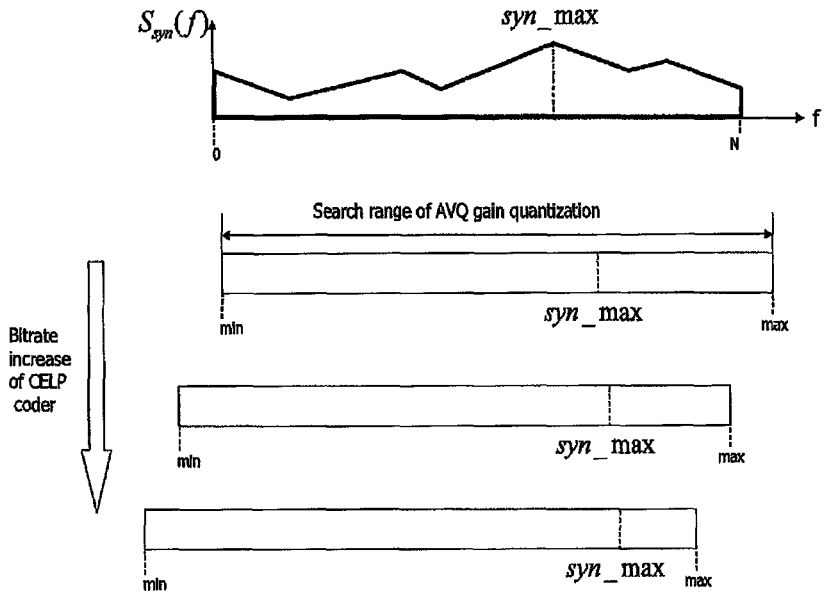
FIG. 28 illustrates the idea of Adaptive determination of searching range of the gain quantization according to CELP coder bit rate.

If the CELP core codec has different bit rates, it is preferable to design different narrow downed ranges for different bitrate of the CELP coder. As shown in FIG. 28, the higher bitrate of the CELP coder, the error signal is smaller comparing to the original signal, the synthesized signal is closer to the original signal, therefore the ratio between the error signal and the synthesized signal is smaller. Then the searching range of the ratio should be biased to smaller range.

In this embodiment, an adaptive global gain quantization method is introduced. The method consists of steps:

1) Extracts the amplitude information from the CELP synthesized signal $S_{syn}(f)$
2) Narrows down the searching range for the global gain according to the extracted amplitude information
3) Quantizes the gain in the narrow downed searching range Because the searching range of the gain is narrowed down, fewer bits are required for the gain quantization.

(Embodiment 10)

The feature of this embodiment is the bits saved from the spectral cluster analysis method are utilized to improve the gain accuracy for the quantized vectors.

Figure 29:
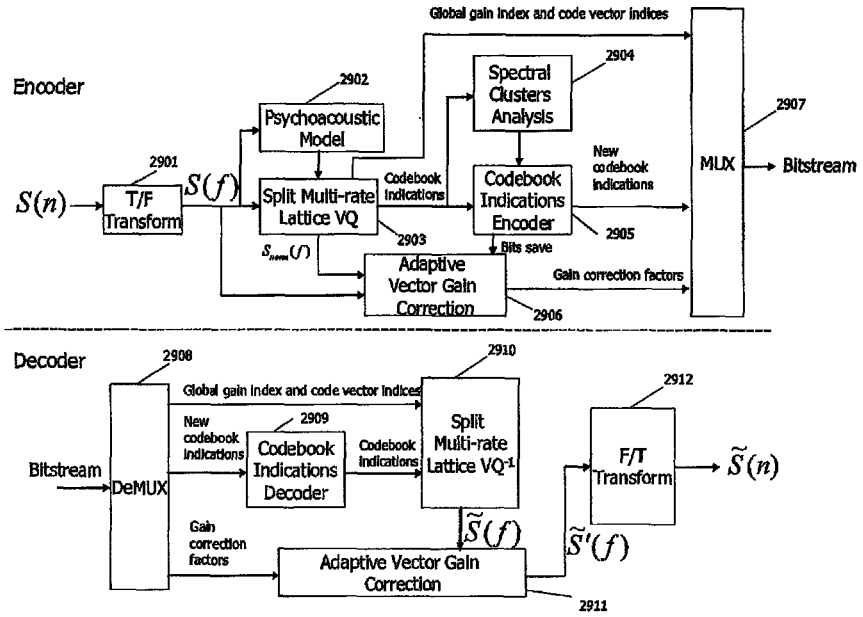
FIG. 29 illustrates the proposed framework with adaptive vector gain correction.

FIG. 29 illustrates the invented codec, which comprises an encoder and a decoder that utilize the bits saved to give a finer resolution to the global gain by dividing the spectrum into smaller bands and assigning a 'gain correction factor' to each band.

The encoding and decoding process is almost the same as in embodiment 1, except that the bits saved from the proposed method in embodiment 1 are used to improve the gain accuracy by applying the adaptive vector gain correction on the global gain (2906).

The adaptive vector gain correction is designed to correct the gain according to the number of bits saved from the spectral clusters analysis method. If the bits saved are very few, then the spectrum is split to a smaller number of sub bands, and one gain correction factor is computed for each sub band. On the other hand, if the bits saved are quite many, then the spectrum is split to a larger number of sub bands, and one gain correction factor is computed for each sub band. The gain correction factor for the sub band which has the coefficients indexing from M to N can be computed in the equation below:

$$Gain_{new} = \frac{\sum_{f=M}^{N} S(f) * S_{norm}(f)}{\sum_{f=M}^{N} S_{norm}(f) * S_{norm}(f)} \quad \text{(Equation 47)}$$

$$Gain_{correction} = \frac{Gain_{new}}{Gain_{original}} \quad \text{(Equation 48)}$$

where

S(f) are the input spectral coefficien ts to the split multi-rate VQ $S_{norm}$ (f) are the output spectral coefficien ts from the split multi-rate VQ M is starting index of the coefficien ts in the target sub band N is the last index of the coefficien ts in the target sub band $Gain_{original}$ is the original global gain $Gain_{new}$ is the new gain derived for the target subband $Gain_{correction}$ is the derived correction factor for the target subband The gain correction factors are multiplexed (2907) and transmitted to decoder side.

In the decoder side, the gain correction factors are used to correct the decoded spectrum $\tilde{S}(f)$ (2911) according to the equation below:

$$\tilde{S}'(f)=\tilde{S}(f)*Gain_{correction} \quad \text{(Equation 49)}$$

where $\tilde{S}(f)$ are the decoded spectral coefficien ts from the split multi-rate VQ $\tilde{S}'(f)$ are the gain corrected spectral coefficien ts $Gain_{correction}$ is the derived correction factor for the target subband The gain corrected spectrum $\tilde{S}'(f)$ is transformed back to time domain, to reconstruct the decoded time domain signal $\tilde{S}(n)$ using frequency to time transformation method (2912), such as Inverse Discrete Fourier Transform (IDFT) or Inverse Modified Discrete Cosine Transform (IMDCT).

In this embodiment, the bits saved from the spectral cluster analysis are utilized to give a finer resolution to the global gain by dividing the spectrum into smaller bands and assigning a 'gain correction factor' to each band. By utilizing the bits saved to transmit the gain correction factors, the quantization performance can be improved, sound quality can be improved.

The spectral cluster analysis method can be applied to encoding of stereo or mutli-channel signals. For example, the invented method is applied for encoding of side-signals and the saved bits are used in principal-signal coding. This would bring subjective quality improvement because principal-signal is perceptually more important than side-signal.

Furthermore, the spectral cluster analysis (SCA) method can be applied to the codec which encodes spectral coefficients in the plural frames basis (or plural sub frames basis). In this application, the saved bits by SCA can be accumulated and utilized to encode spectral coefficients or some other parameters in the next coding stage.

Furthermore, the bits saved from spectral cluster analysis can be utilized in FEC (Frame Erasure Concealment), so that the sound quality can be retained in frame lost scenarios.

Although all of the embodiments above are explained using split multi-rate lattice vector quantization, this invention is not limited to use of split multi-rate lattice vector quantization and it can be applied to other spectral coefficients coding method. Those who are skilled in the art will be able to modify and adapt this invention without deviating from the spirit of the invention.

Also, although the decoding apparatus of the above embodiments performs processing using encoded information outputted from the encoding apparatus of the above embodiments, the present invention is not limited to this, and, even if encoded information is not transmitted from the encoding apparatus, the decoding apparatus can perform processing as long as this encoded data contains necessary parameters and data.

Also, the encoding apparatus and decoding apparatus according to the present invention can be mounted on a communication terminal apparatus and base station apparatus in a mobile communication system, so that it is possible to provide a communication terminal apparatus, base station apparatus and mobile communication system having the same operational effects as above.

Although example cases have been described with the above embodiments where the present invention is implemented by hardware, the present invention can be implemented by software in cooperation with hardware.

Also, the present invention is applicable even to a case where a signal processing program is operated after being recorded or written in a mechanically readable recording medium such as a memory, disk, tape, CD, and DVD, so that it is possible to provide the same operations and effects as in the present embodiments.

Furthermore, each function block employed in the description of each of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2010-154232, filed on Jul. 6, 2010, including the specification, drawings and abstract, is incorporated herein by reference in its entirety.

Industrial Applicability

The encoding apparatus, decoding apparatus and encoding and decoding methods according to the present invention are applicable to a wireless communication terminal apparatus, base station apparatus in a mobile communication system, tele-conference terminal apparatus, video conference terminal apparatus and voice over interne protocol (VoIP) terminal apparatus.

The invention claimed is:

1. An audio/speech encoding apparatus, comprising:

a band splitting section that splits a spectrum of input signal to a plurality of sub-bands;

a vector quantization section that quantizes spectral coefficients in each sub-band;

a spectral analysis section that splits the spectrum to null vectors region and non-null vectors region by analyzing on a series of indications of sub-bands generated by vector quantization; and a parameter encoding section that converts the series of indications for null vectors in the null vector region to an indication of null vectors region and a parameter which represents the ending position of the null vectors region, wherein the parameter encoding section comprises:

a first parameter encoding section that converts the series of indications for null vectors in the null vector region to an indication of null vectors region and a parameter which represents the ending position of the null vectors region;

a reversing section that reverses the series of indications;

a second parameter encoding section that converts the reversed series of indications for null vectors; and a selection section that selects between the first parameter encoding section and the second parameter encoding section based on which consumes less bits; and wherein audio/speech is encoded in accordance with the selection by the selection section.

2. The audio/speech encoding apparatus of claim 1, wherein bits saved from the conversion of the series of indications for null vectors in the null vector region are utilized to give a finer resolution to global gain by splitting the spectrum into sub-bands and assigning a gain correction factor to at least one sub-band.

3. An audio/speech encoding apparatus, comprising:

a band splitting section that splits a spectrum of input signal to a plural of sub-bands;

a vector quantization section that quantizes spectral coefficients in each sub-band;

a spectral analysis section that splits the spectrum to null vectors region and non-null vectors region by analyzing on a series of indications of sub-bands generated by vector quantization; and a parameter encoding section that converts the series of indications for null vectors in the null vector region to an indication of null vectors region and a parameter which represents the ending position of the null vectors region, wherein the parameter encoding section comprises:

a first parameter encoding section that converts the series of indications for null vectors in the null vector region to an indication of null vectors region and a parameter which represents the ending position of the null vectors region;

a second parameter encoding section that converts the series of indications for null vectors in the null vector region to an indication of null vectors region and a parameter which represents the number of null vectors in the null vectors region by multiplying one of pre-determined scalars with the value of starting index; and a selecting section that selects between the first parameter encoding section and the second parameter encoding section based on which consumes less bits;

wherein audio/speech is encoded in accordance with the selection by the selecting section.

4. The audio/speech encoding apparatus of claim 3, wherein bits saved from the conversion of the series of indications for null vectors in the null vector region are utilized to give a finer resolution to global gain by splitting the spectrum into sub-bands and assigning a gain correction factor to at least one sub-band.

5. An audio/speech decoding apparatus, comprising:

an indication decoding section that decodes an indication of null vectors region;

an ending position decoding section that decodes a parameter which represents the ending position of the null vectors region;

a parameter conversion section that converts the indication of null vectors region and the parameter which represents the ending position of the null vectors region to a series of indications for null vectors in the null vector region;

a vector dequantization section that dequantizes spectral coefficients in each of a plurality of sub-bands;

a frequency to time domain transformation section that transforms the dequantized spectral coefficients to time domain to generate an output signal;

a selection parameter decoding section that decodes the selection information indicating whether the series of indications for null vectors in the null vector region is reversed in an audio/speech encoding apparatus; and a reverse section that reverses the series of indications when the selection information indicates the reverse operation in the audio/speech encoding apparatus is performed;

wherein audio/speech is decoded in accordance with the selection information.

6. An audio/speech decoding apparatus of claim 5, further comprising:

a first parameter conversion section that converts an indication of null vectors region and a parameter which represents the ending position of the null vectors region to a series of indications for null vectors in the null vector region;

a second parameter conversion section that converts an indication of null vectors region and a parameter which represents the number of null vectors in the null vectors region by multiplying one of pre-determined scalars with the value of starting index to a series of indications for null vectors in the null vector region; and a selection parameter decoding section that decodes the selection information indicating either the first parameter conversion section or the second parameter conversion section is applied.

7. An audio/speech decoding apparatus of claim 5, wherein the decoded spectrum is further processed by:

a band splitting section that splits a decoded spectrum to a number of sub bands; and a gain correction section that scales the decoded spectrum with gain correction factors.

8. An audio/speech encoding method, comprising:

splitting a spectrum of input signal to a plural of sub-bands;

quantizing spectral coefficients in each sub-band;

splitting the spectrum to null vectors region and non-null vectors region by analyzing on a series of indications of sub-bands generated by vector quantization; and converting the series of indications for null vectors in the null vector region to an indication of null vectors region and a parameter which represents the ending position of the null vectors region, wherein the converting includes first converting the series of indications for null vectors in the null vector region to an indication of null vectors region and a parameter which represents the ending position of the null vectors region, reversing the series of indications, second converting the reversed series of indications for null vectors, and selecting between the first converting and the second converting based on which consumes less bits; and wherein audio/speech is encoded in accordance with the selecting.

9. An audio/speech decoding method, comprising:

decoding an indication of null vectors region;

decoding a parameter which represents the ending position of the null vectors region;

converting the indication of null vectors region and the parameter which represents the ending position of the null vectors region to a series of indications for null vectors in the null vector region;

dequantizing spectral coefficients in each sub-band; and transforming the dequantized spectral coefficients to time domain to generate an output signal;

decoding the selection information indicating whether a series of indications for null vectors in the null vector region is reversed in an audio/speech encoding apparatus; and reversing the series of indications when the selection information indicates the reverse operation in the audio/speech encoding apparatus is performed; and wherein audio/speech is decoded in accordance with the selection information.

10. An audio/speech encoding method, comprising:

splitting a spectrum of input signal to a plural of sub-bands;

quantizing spectral coefficients in each sub-band;

splitting the spectrum to null vectors region and non-null vectors region by analyzing on a series of indications of sub-bands generated by vector quantization; and converting the series of indications for null vectors in the null vector region to an indication of null vectors region and a parameter which represents the ending position of the null vectors region, wherein the converting includes first converting the series of indications for null vectors in the null vector region to an indication of null vectors region and a parameter which represents the ending position of the null vectors region, second converting the series of indications for null vectors in the null vector region to an indication of null vectors region and a parameter which represents the number of null vectors in the null vectors region by multiplying one of predetermined scalars with the value of starting index, and selecting between the first converting and second converting based on which consumes less bits;

wherein audio/speech is encoded in accordance with the selecting.

11. An audio/speech encoding apparatus, comprising:

a memory that stores instructions; and a processor that executes the instructions, wherein, when executed by the processor, the instructions cause the audio/speech encoding apparatus to perform operations comprising:

splitting a spectrum of input signal to a plural of sub-bands;

quantizing spectral coefficients in each sub-band;

splitting the spectrum to null vectors region and non-null vectors region by analyzing on a series of indications of sub-bands generated by vector quantization; and converting the series of indications for null vectors in the null vector region to an indication of null vectors region and a parameter which represents the ending position of the null vectors region, by first converting the series of indications for null vectors in the null vector region to an indication of null vectors region and a parameter which represents the ending position of the null vectors region, reversing the series of indications, second converting the reversed series of indications for null vectors, and selecting between the first converting and the second converting based on which consumes less bits, wherein audio/speech is encoded in accordance with the selecting.

* * * * *